US009488937B2

(12) United States Patent
Tanaka et al.

(10) Patent No.: US 9,488,937 B2
(45) Date of Patent: Nov. 8, 2016

(54) IMAGE FORMING APPARATUS

(71) Applicants: Shinya Tanaka, Kanagawa (JP); Hirokazu Ishii, Tokyo (JP); Hiromi Ogiyama, Tokyo (JP); Yasunobu Shimizu, Kanagawa (JP); Keigo Nakamura, Kanagawa (JP)

(72) Inventors: Shinya Tanaka, Kanagawa (JP); Hirokazu Ishii, Tokyo (JP); Hiromi Ogiyama, Tokyo (JP); Yasunobu Shimizu, Kanagawa (JP); Keigo Nakamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/739,482

(22) Filed: Jan. 11, 2013

(65) Prior Publication Data

US 2013/0177329 A1 Jul. 11, 2013

(30) Foreign Application Priority Data

Jan. 11, 2012 (JP) ..... 2012-003399
Nov. 9, 2012 (JP) ..... 2012-247794

(51) Int. Cl.
*G03G 15/16* (2006.01)
*G03G 15/01* (2006.01)
*G03G 21/00* (2006.01)

(52) U.S. Cl.
CPC ..... *G03G 15/1695* (2013.01); *G03G 15/0189* (2013.01); *G03G 15/161* (2013.01); *G03G 15/168* (2013.01); *G03G 21/0094* (2013.01)

(58) Field of Classification Search
CPC .. G03G 15/166; G03G 15/168; G03G 15/16; G03G 15/1675
USPC ..... 399/101, 121, 123, 350, 302, 297
See application file for complete search history.

(56) References Cited

U.S. PATENT DOCUMENTS 3,501,294 A 3/1970 Joseph
3,664,300 A 5/1972 Joseph
(Continued)

FOREIGN PATENT DOCUMENTS

JP 51-22380 7/1976
JP 2-300774 A 12/1990
(Continued)

OTHER PUBLICATIONS

Translation of JP2006267486.*
(Continued)

*Primary Examiner* — Walter L Lindsay, Jr.
*Assistant Examiner* — Ruifeng Pu
(74) *Attorney, Agent, or Firm* — Oblon, McClelland, Maier & Neustadt, L.L.P

(57) ABSTRACT

An image forming apparatus includes an image carrier that carries an electrostatic latent image; a developing unit that develops the electrostatic latent image using a toner; an intermediate transfer body onto which toner image is transferred; a secondary transfer member that comes in contact with a surface of the intermediate transfer body; a power supply that outputs a voltage for transferring the toner image on the intermediate transfer body onto a recording member; and a protective agent supply unit that applies a protective agent including zinc stearate and boron nitride onto a surface of the image carrier. The voltage is alternatively switched in a transfer direction and an opposite direction. The voltage in the transfer direction enables transfer of the toner image from the intermediate transfer body to the recording member, and the voltage in the opposite direction has polarity opposite to polarity of the voltage in the transfer direction.

32 Claims, 12 Drawing Sheets

(56) References Cited

U.S. PATENT DOCUMENTS

| | | | | |
|---|---|---|---|---|
| 3,860,857 | A * | 1/1975 | Namiki | G03G 15/1635 361/230 |
| 5,812,919 | A | 9/1998 | Takano et al. | |
| 7,742,721 | B2 * | 6/2010 | Mimbu | 399/121 |
| 8,626,011 | B2 | 1/2014 | Yamada | |
| 2001/0031159 | A1 | 10/2001 | Ogiyama et al. | |
| 2003/0016968 | A1 | 1/2003 | Takahashi et al. | |
| 2003/0026625 | A1 | 2/2003 | Tamiya et al. | |
| 2003/0185581 | A1 * | 10/2003 | Hisada | 399/45 |
| 2006/0285897 | A1 | 12/2006 | Sugiura et al. | |
| 2007/0224528 | A1 | 9/2007 | Yamashita et al. | |
| 2008/0118286 | A1 | 5/2008 | Yamashita et al. | |
| 2008/0138132 | A1 | 6/2008 | Yamashita et al. | |
| 2009/0176669 | A1 | 7/2009 | Sugiura et al. | |
| 2009/0196665 | A1 | 8/2009 | Tanaka et al. | |
| 2009/0279930 | A1 | 11/2009 | Kabata et al. | |
| 2009/0285613 | A1 | 11/2009 | Nakai et al. | |
| 2009/0290919 | A1 | 11/2009 | Tanaka et al. | |
| 2009/0304423 | A1 | 12/2009 | Ozaki et al. | |
| 2009/0311014 | A1 | 12/2009 | Tanaka et al. | |
| 2010/0008687 | A1 | 1/2010 | Ishii | |
| 2010/0034560 | A1 | 2/2010 | Tanaka et al. | |
| 2010/0054829 | A1 | 3/2010 | Iio et al. | |
| 2010/0183972 | A1 | 7/2010 | Hasegawa et al. | |
| 2010/0209143 | A1 | 8/2010 | Nakai et al. | |
| 2010/0239309 | A1 | 9/2010 | Tanaka et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0206431 | A1 * | 8/2011 | Tawada et al. | 399/346 |
| 2011/0229168 | A1 | 9/2011 | Shiraishi et al. | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |
| 2012/0057912 | A1 | 3/2012 | Hasegawa et al. | |
| 2012/0060753 | A1 | 3/2012 | Tanaka et al. | |
| 2012/0063809 | A1 | 3/2012 | Tanaka et al. | |
| 2012/0063825 | A1 | 3/2012 | Hasegawa et al. | |
| 2012/0170951 | A1 | 7/2012 | Ishii | |
| 2012/0195662 | A1 | 8/2012 | Hasegawa et al. | |
| 2012/0230715 | A1 | 9/2012 | Ogino et al. | |
| 2012/0237234 | A1 | 9/2012 | Sugimoto et al. | |
| 2012/0237271 | A1 | 9/2012 | Sengoku et al. | |
| 2012/0243892 | A1 | 9/2012 | Nakamura et al. | |
| 2012/0308250 | A1 | 12/2012 | Shimizu et al. | |
| 2012/0315058 | A1 | 12/2012 | Shimizu et al. | |
| 2012/0321336 | A1 | 12/2012 | Ogiyama | |
| 2012/0328314 | A1 | 12/2012 | Sugimoto et al. | |
| 2012/0328315 | A1 | 12/2012 | Takeuchi et al. | |
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |

FOREIGN PATENT DOCUMENTS

| | | |
|---|---|---|
| JP | 09-106192 | 4/1997 |
| JP | 09-146381 | 6/1997 |
| JP | 2006-267486 | 10/2006 |
| JP | 2006-350240 | 12/2006 |
| JP | 2010-217715 | 9/2010 |
| JP | 2011-047969 | 3/2011 |
| JP | 2011-095528 A | 5/2011 |
| JP | 2011-186176 A | 9/2011 |

OTHER PUBLICATIONS

Machine Translation of JP H09106192.*

Machine Translation of JP H09106192 (Apr. 22, 1997).*

U.S. Appl. No. 13/527,153, filed Jun. 19, 2012, Junpei Fujita, et al.

U.S. Appl. No. 13/541,211, filed Jul. 3, 2012, Hiromi Ogiyama, et al.

U.S. Appl. No. 13/556,916, filed Jul. 24, 2012, Hiromi Ogiyama.

U.S. Appl. No. 13/680,629, filed Nov. 19, 2012, Hiromi Ogiyama, et al.

U.S. Appl. No. 13/666,474, filed Nov. 1, 2012, Yasunobu Shimizu, et al.

U.S. Appl. No. 13/602,840, filed Sep. 4, 2012, Keigo Nakamura, et al.

U.S. Appl. No. 13/646,898, filed Oct. 8, 2012, Ryuuichi Mimbu, et al.

U.S. Appl. No. 13/633,341, filed Oct. 2, 2012, Yasunobu Shimizu, et al.

U.S. Appl. No. 13/651,776, filed Oct. 15, 2012, Shinya Tanaka, et al.

* cited by examiner $$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

IMAGE FORMING APPARATUS

CROSS-REFERENCE TO RELATED APPLICATIONS

The present application claims priority to and incorporates by reference the entire contents of Japanese Patent Application No. 2012-003399 filed in Japan on Jan. 11, 2012 and Japanese Patent Application No. 2012-247794 filed in Japan on Nov. 9, 2012.

BACKGROUND OF THE INVENTION

1. Field of the Invention

The present invention relates to an image forming apparatus, which supplies a protective agent to an image carrier and uses a voltage including an AC bias for transferring a toner image formed on the image carrier to a recording member.

2. Description of the Related Art

Typical examples of an image forming apparatus are an electrographic copier, a FAX, a printer, and an MFP in combination with these multi-functions. Japanese Patent Application Laid-open No. 2006-267486 discloses a known technique for transferring the toner image on the surface of the image carrier toward the recording member which has been put in the transfer nip. The image forming apparatus of Japanese Patent Application Laid-open No. 2006-267486 forms a toner image on the surface of the drum-like photosensitive element through a known electrophotography process, makes the photosensitive element in contact with an intermediate transfer belt as an intermediate transfer body with an endless loop form to form a primary transfer nip, and primarily transfers the toner image on the photosensitive element to the intermediate transfer belt in the primary transfer nip. The intermediate transfer belt is designed to be in contact with the secondary transfer roller as a nip forming member from the outside to form a secondary transfer nip. A transfer facing roller is arranged inside the loop of the belt, and the intermediate transfer belt is put between the secondary transfer facing roller and the secondary transfer roller. Ground connection is made on the secondary transfer facing roller inside the loop, and a secondary transfer bias is applied to the secondary transfer roller outside the loop. As a result, a secondary transfer field is formed for electrostatically moving the toner image from the secondary transfer facing roller to the secondary transfer roller, between the secondary transfer facing roller and the secondary transfer roller. The toner image on the intermediate transfer belt is secondarily transferred by the effects of the secondary transfer field or the nip pressure, onto the recording member sent into the secondary transfer nip at a timing for synchronizing with the toner image on the intermediate transfer belt.

In this configuration, as a recording member, if a sheet of paper (for example, Japanese paper) with a large uneven surface is used, a gray-scale pattern is likely to appear in the image in accordance with the surface irregularities. This gray-scale pattern occurs as a result that the image density in the concave portion is lower than that in the convex portion, because a sufficient amount of toner is not transferred to the concave portion in the surface of the paper. In the image forming apparatus of Japanese Patent Application Laid-open No. 2006-267486, as a secondary transfer bias, a superimposed bias on which a DC voltage is superimposed on an AC voltage is applied, instead of a bias including only a DC voltage. In Japanese Patent Application Laid-open No. 2006-267486, by applying this secondary transfer bias, occurrence of a gray-scale pattern is restrained, as compared to a case in which a secondary transfer bias including only a DC voltage is applied.

In the configuration of Japanese Patent Application Laid-open No. 2006-267486, the present inventors of the invention have found that the cleaning performance is degraded in the intermediate transfer belt or the secondary transfer roller. This phenomenon occurs in the photosensitive element cleaning having a charging step. This can be considered due to deterioration of the image carrier, the charging member, and the cleaning member. This deterioration results from occurrence of an electrical stress in a charging step by a charging unit for electrically charging the photosensitive element.

To solve this problem, many proposals have been presented on a supplying method and a film-forming method, for various lubricants and lubricant components, to reduce the deterioration of the image carrier, the charging member, and the cleaning member.

For example, to extend the life of the photosensitive element as the image carrier and the cleaning blade, Japanese Patent 51-22380 suggests a technique for supplying a solid lubricant agent mainly including zinc stearate onto the surface of the photosensitive element and forming a lubricant film on the surface of the photosensitive element. This results in suppressing the abrasion on the surface of the photosensitive element and extending the life of the image carrier. However, in Japanese Patent 51-22380, it is obvious that metal salt of fatty acid (representatively, zinc stearate) loses its lubricity in the early stage, by the effect of the discharge performed in the vicinity of the image carrier during the charging step. As a result, the lubricity between the cleaning blade and the image carrier is lowered, and the toner passes therethrough, resulting in a poor image.

To solve this problem, Japanese Patent Application Laid-open No. 2006-350240 suggests a technique for applying a protective agent with a compound of metal salt of fatty acid and boron nitride to the image carrier. In this structure, even with the effect of the discharge performed in the vicinity of the image carrier during the charging step, the lubricity between the cleaning blade and the image carrier is maintained, thus enabling to prevent passing of the toner.

As disclosed in Japanese Patent Application Laid-open No. 2006-267486, applying of the AC field to the transfer nip is to improve the transferability of toner to a recording member with surface irregularities. In many cases, only a DC electric field is applied. Thus, as disclosed in Japanese Patent Application Laid-open No. 2006-350240, even if the protective agent with a compound of metal salt of fatty acid and boron nitride is applied to the intermediate transfer belt, no particular effect is attained in the normal image formation with application of only a DC electric field, in spite of the high cost.

Therefore, there is a need for a image forming apparatus capable of improving cleaning performance of an intermediate transfer body, while attaining an image of stable density.

SUMMARY OF THE INVENTION

According to an embodiment, there is provided an image forming apparatus that includes an image carrier that carries an electrostatic latent image; a developing unit that develops the electrostatic latent image using a toner; an intermediate transfer body onto which a toner image developed by the developing unit is transferred once or a plurality of times and carries the toner image; a secondary transfer member that comes in contact with a surface of the intermediate transfer body on which the toner image is carried, to form a transfer nip; a power supply that outputs a voltage for transferring the toner image on the intermediate transfer body onto a recording member put in the transfer nip; and a first protective agent supply unit that applies or attaches a protective agent including at least both of zinc stearate and boron nitride onto a surface of the image carrier. The voltage is alternatively switched in a transfer direction and an opposite direction when the toner image on the intermediate transfer body is transferred to the recording member. The voltage in the transfer direction enables transfer of the toner image from the intermediate transfer body to the recording member, and the voltage in the opposite direction has polarity opposite to polarity of the voltage in the transfer direction.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 14A illustrates a state before compression, FIG. 14B illustrates a compression state, and FIG. 14C illustrates a separation state;

DETAILED DESCRIPTION OF THE PREFERRED EMBODIMENTS

A plurality of preferred embodiments of the image forming apparatus according to the present invention will now be described with reference to the accompanying drawings. In each embodiment, the same or corresponding elements are identified with the same numeral symbols, and will be briefly described again or will not be repeated.

First Embodiment

Figure 1:
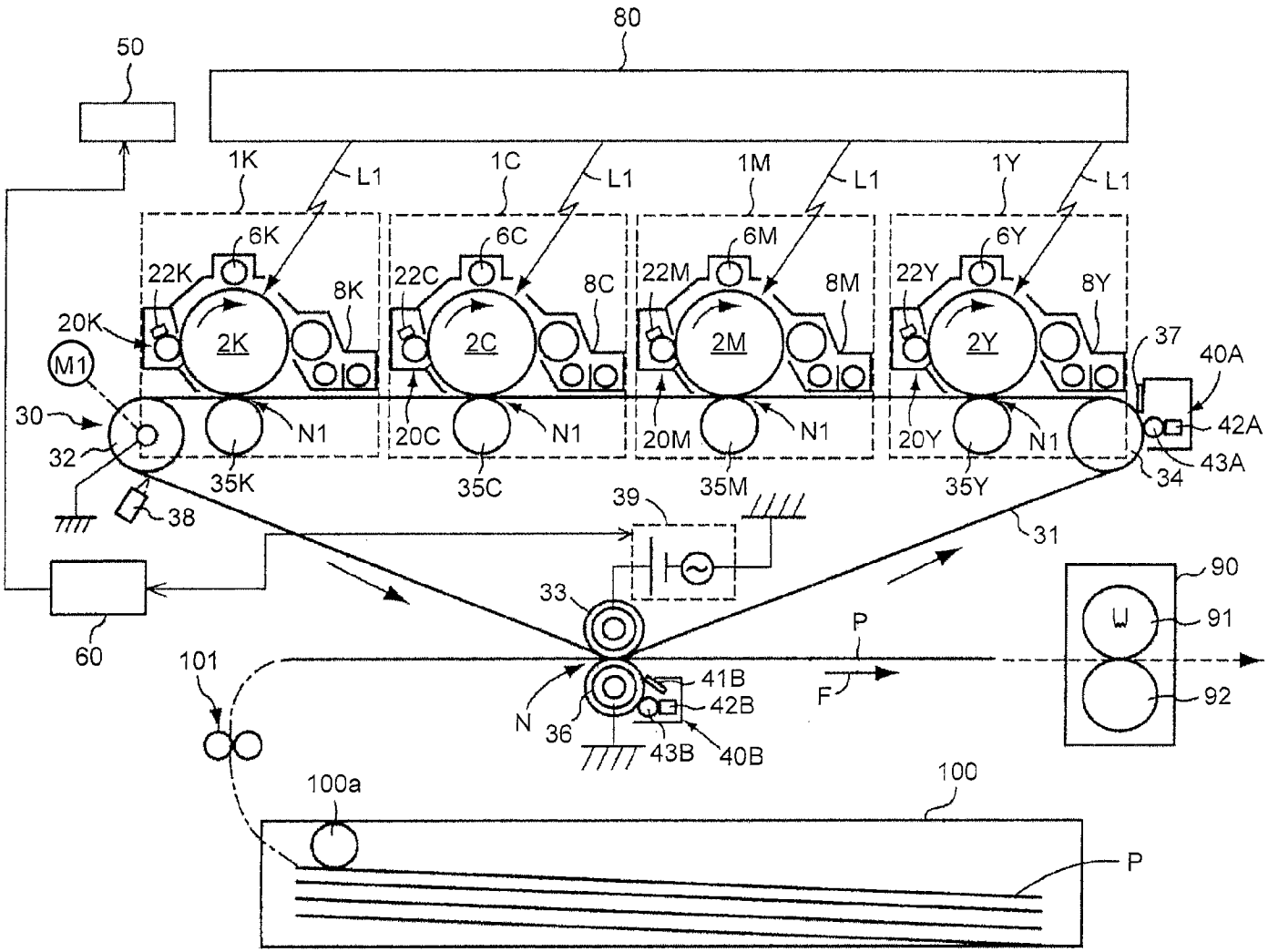
FIG. 1 is a schematic diagram of a printer as an example of an image forming apparatus according to a first embodiment of the present invention.

An image forming apparatus according to the embodiment of FIG. 1 is an electrophotography color printer (hereinafter simply referred to as a "printer"). FIG. 1 is a schematic block diagram illustrating the printer according to this embodiment. In this illustration, the printer includes four image forming units 1Y, 1M, 1C, and 1K for forming a yellow (Y) toner image, a magenta (M) toner image, a cyan (C) toner image, and a black (K) toner image. The printer includes a transfer unit 30 as a transfer device, an optical writing unit 80, a fixing device 90, a paper cassette 100, and a control unit 60 as a controlling device.

Figure 2:
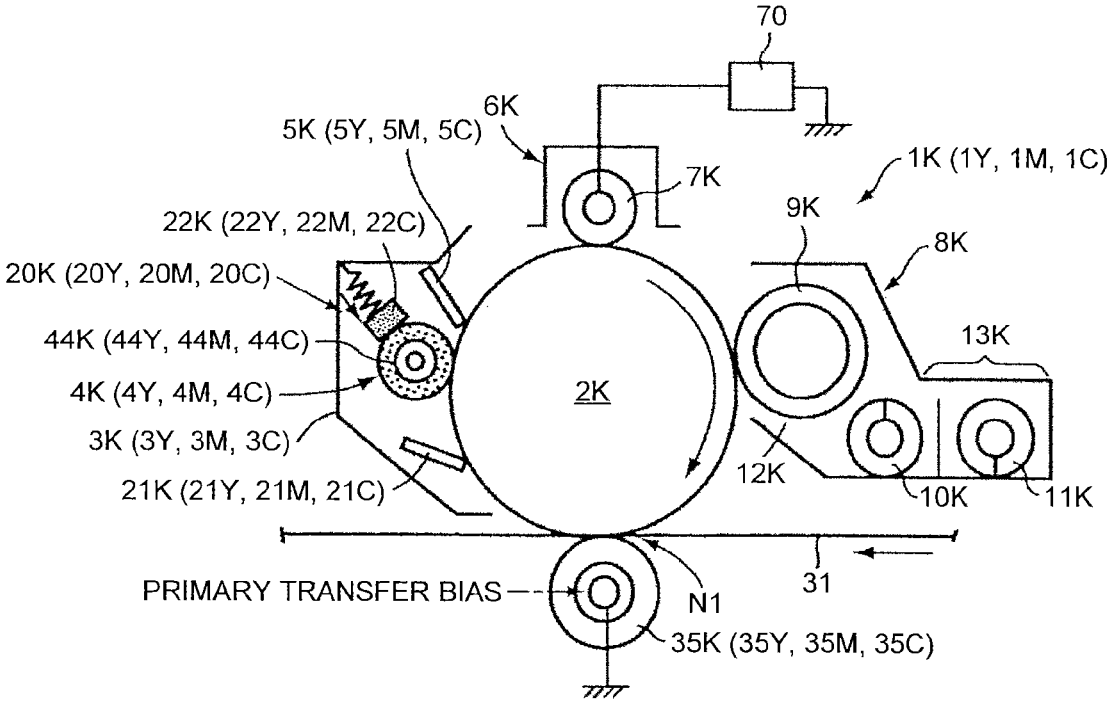
FIG. 2 is an enlarged diagram illustrating a schematic view of an image forming unit for "K" in the printer of FIG. 1.

The four image forming units 1Y, 1M, 1C, and K respectively use Y, M, C, and K toners that are different from each other, as image forming materials. The rest of the elements are the same between the units, and are replaced with a new one at the end of their lives. The image forming unit 1K for forming a K toner image will now be described by way of example. This image forming unit 1K includes, as illustrated in FIG. 2, a photosensitive element 2K with a drum-like form as an image carrier, a drum cleaning unit 3K, a neutralization unit (not illustrated), a charging unit 6K, and a developing unit 8K. These constituent elements of the image forming unit 1K are kept in the common casing, and thus the unit is integrally attachable/detachable to/from the printer. These constituent elements can be replaced at the same time.

The photosensitive element 2K includes an organic photosensitive layer formed on the surface of the drum-like substrate, and is rotationally driven in a clock-wise direction of the illustration by a driving unit (not illustrated). In this embodiment, the organic photosensitive layer of the photosensitive element 2K includes an ultraviolet cured resin. The general organic photosensitive element is manufactured by applying a resin melted with a solvent onto a metal drum and drying the resin thereon. However, like the photosensitive element 2K of this embodiment, with the ultraviolet cured resin, the organic photosensitive element is manufactured by: applying a low molecular resin onto the metal drum; irradiating it with ultraviolet rays thereonto; and cross-linking a low molecular resin to cure it.

The charging unit 6K causes a roller charging device 7K, as a charging member to which a charging bias is applied, to be in contact with or adjacent to the photosensitive element 2K. Simultaneously, the charging unit 6K generates a discharge of electricity between the roller charging device 7K and the photosensitive element 2K, thereby uniformly charging the surface of the photosensitive element 2K. In this printer, the charging is performed uniformly in the negative polarity as the same as the normal charging polarity of the toner. More specifically, the charging is performed uniformly with −650 [V]. In this embodiment, an alternating voltage superimposed on a direct voltage is applied, as a charging bias. The charging bias having this alternating component is applied onto the roller charging device 7K by a power supply 70 as a charging voltage applying unit. The roller charging device 7K has core metal whose surface is covered with a conductive elastic layer including a conductive elastic material. As the charging unit 6K, a non-contact charging method may be applied, instead of a method for causing the charging member (roller charging device) to be in contact with or adjacent to the photosensitive element 2K.

The surface of the photosensitive element 2K which is uniformly charged by the charging unit 6K is scanned with laser light generated from the optical writing unit 80, and supports an electrostatic latent image for K. The electrical potential of the electrostatic latent image for K is approximately −100 [V]. The electrostatic latent image for K will be a K toner image, after being developed by the developing unit 8K using a K toner (not illustrated). Then, the toner image will be primarily transferred onto an intermediate transfer belt 31 having an endless-loop form, as an intermediate transfer body as will be described later.

The drum cleaning unit 3K is to remove residual toner attached onto the surface of the photosensitive element 2K after undergoing a primary transfer step (primary transfer nip N1, as will be described later). The drum cleaning unit 3K has a cleaning blade 21K as a cleaning member, a protective agent 22K, a protective agent supply roller 4K as a supply member to be rotationally driven, and an applying blade 5K. The drum cleaning unit 3K collects the residual toner with the cleaning blade 21K from the surface of the photosensitive element 2K, applies the protective agent 22K being in contact with the surface using the protective agent supply roller 4K, and uniformly covers the surface of the photosensitive element 2K using the applying blade 5K. That is, the applying blade 5K includes a layer forming member for pressing the protective agent 22K supplied onto the surface of the photosensitive element 2K to form a coated film thereon. The protective agent supply roller 4K is a supplying member, and has a foaming elastic layer 44 on its surface. In this embodiment, a protective agent supply unit 20K includes the protective agent supply roller 4K, the applying blade 5K, and the protective member 22K. The cleaning blade 21K is in contact with the photosensitive element 2K in a counter direction in which a cantilever supported end directed toward the downstream side of the drum rotational direction with respect to the free end side.

The neutralization device neutralizes the residual charge of the photosensitive element 2K after cleaned by the drum cleaning unit 3K. As a result of this neutralization, the surface of the photosensitive element 2K is initialized and will be ready for forming the next image.

The developing unit 8K has a developing unit 12K, including a developing roll 9K, and a developer carrying unit 13K which stirs and carries a "K developer" (not illustrated). The developer carrying unit 13K has a first carrier chamber containing a first screw member 10K and a second carrier chamber containing a second screw member 11K. These screw members include a rotating shaft member, whose both ends in the axis direction are rotationally supported by shaft bearings, and a helical blade helically protruding therearound.

The first carrier chamber containing the first screw member 10K and the second carrier chamber containing the second screw member 11K are partitioned with a partition wall. A connecting hole for connecting both carrier chambers is formed in each end part of the partition wall in the direction of screw axis. The first screw member 10K carries a "K developer" (not illustrated) kept in the helical blade, from the far side in an orthogonal direction in the illustration sheet toward the near side therein, while stirring it in a rotational direction in accordance with the rotational driving. The first screw member 10K and the developing roll 9K are facing each other, and are parallelly arranged. Thus, the carrier direction of the K developer is also a direction along the axis direction of the developing roll 9K. The first screw member 10K supplies the K developer onto the surface of the developing roll 9K along its axis direction.

The K developer, carried to the vicinity of the near side end in the illustration sheet of the first screw member 10K, passes through the connecting hole formed in the vicinity of the near side end in the illustration sheet of the partition wall, and enters the second carrier chamber. After this, the developer is kept in the helical blade of the second screw member 11K. Then, the agent is stirred in the rotational direction, and carried from the near side in the illustration sheet to the far side thereof, in accordance with the rotational driving of the second screw member 11K.

In the second carrier chamber, a toner concentration sensor (not illustrated) is provided on the lower wall of the casing, and detects the K toner concentration of the K developer in the second carrier chamber. The K toner concentration sensor may be formed using a magnetic permeability sensor. The magnetic permeability of, what is called, the binary K developer including K toner and a magnetic carrier has correlation with the K toner concentration. Thus, the magnetic permeability sensor detects the K toner concentration.

This printer has toner supply units (not illustrated) respectively for Y, M, C, and K for supplying the toners of Y, M, C, and K into the second housing chamber of the developing units for Y, M, C, and K. The control unit 60 of the printer stores Vtrefs for Y, M, C, and K as target values of output voltage values, from the toner concentration detection sensors for Y, M, C, and K, in its RAM. When a difference between the output voltage value from the toner concentration detection sensors for Y, M, C, and K and the Vtrefs for Y, M, C, and K exceeds a predetermined value, the toner supply units for Y, M, C, and K are driven for a period of time corresponding to the difference. As a result, Y toner, M toner, C toner, and K toner are supplied into the second carrier chamber of the developing units for Y, M, C, and K.

The developing roll 9K contained in the developing unit 12K is opposed to the first screw member 10K, and is also opposed to the photosensitive element 2K through the opening provided in the casing. The developing roll 9K includes a cylindrical developing sleeve, having a non-magnetic pipe to be rotationally driven, and a magnet roller fixed thereinside not to be accompanied by the sleeve. The developing roll 9K carries the K developer supplied from the first screw member 10K into a development space opposed to the photosensitive element 2K in accordance with the rotation of the sleeve, while supporting it on the sleeve surface using a magnetic force generated by the magnet roller.

To the developing sleeve, a developing bias is applied. This bias is larger than a potential of the electrostatic latent image of the photosensitive element 2K and smaller than a uniformly-charged potential of the photosensitive element 2K. As a result, the developing potential causes the K toner on the developing sleeve to move toward the electrostatic latent image, between the developing sleeve and the electrostatic latent image of the photosensitive element 2K. In addition, non-developing potential causes the K toner on the developing sleeve to move toward the surface of the sleeve, between the developing sleeve and the bare surface of the photosensitive element 2K. By the effects of the developing potential and the non-developing potential, the K toner on the developing sleeve is selectively transferred to the electrostatic latent image of the photosensitive element 2K to develop the electrostatic latent image on the K toner image.

In FIG. 1, the image forming units 1Y, 1M, and 1C for Y, M, and C have the same configuration as that of the image forming unit 1K for K. In these units, a Y toner image, an M toner image, and a C toner image are formed respectively on photosensitive elements 2Y, 2M, and 2C. The constituent elements of the image forming units 1Y, 1M, and 10 are identified respectively with Y, M, and C following the corresponding numerical symbols.

The optical writing unit 80 as a latent writing unit is arranged above the image forming units 1Y, 1M, 10, and 1K. The optical writing unit 80 optically scans the photosensitive elements 2Y, 2M, 2C, and 2K, using laser light generated from a light source (laser diode), based on image information sent from an external unit, such as a personal computer. By this optical scanning, electrostatic latent images for Y, M, C, and K are formed on the photosensitive elements 2Y, 2M, 2C, and 2K. Specifically, of the uniformly-charged entire surface area of the photosensitive element 2Y, a part irradiated with the laser beam has attenuated potential. As a result, there is formed an electrostatic latent image in which the potential of the part irradiated with the laser beam is smaller than the potential of other parts (bare surface part). The optical writing unit 80 is to irradiate each photosensitive element through a plurality of optical lenses or mirrors with the laser light L generated from the light source, while making the light polarized in a horizontal scanning direction using a polygon mirror which is rotationally driven by a polygon motor (not illustrated). As the optical writing unit 80, it is possible to use a unit which performs optical writing onto the photosensitive elements 2Y, 2M, 2C and 2K using LED light generated from a plurality of LEDs of an LED array.

The transfer unit 30 is arranged below the image forming units 1Y, 1M, 10, and 1K, and moves the intermediate transfer belt 31 having an endless-loop form in counter-clockwise rotation in the illustration, while stretching it as an intermediate transfer body. The transfer unit 30 includes a driving roller 32, a secondary transfer back-surface roller 33, a cleaning backup roller 34, and primary transfer rollers 35Y, 35M, 35C, and 35K as four primary transfer members. The transfer unit 30 includes a nip-forming roller 36 as a secondary transfer member, a cleaning blade 37 as a belt cleaning member, and a protective agent applying unit 40A. The cleaning blade 37 and the protective agent applying unit 40A are arranged near the surface of the cleaning backup roller 34. The protective agent applying unit 40A includes a protective agent 42A and a protective agent supply roller 43A. The protective agent supply roller 43A comes in contact with the top surface of the intermediate transfer belt 31 in a position opposed to the cleaning backup roller 34, and comes in press-contact with the protective agent 42A. The cleaning blade 37 is arranged in contact with the top surface of the intermediate transfer belt 31.

The intermediate transfer belt 31 is stretched by the driving roller 32 arranged inside the loop, the secondary transfer back-surface roller 33, the cleaning backup roller 34, and the four primary transfer rollers 35Y, 35M, 35C, and 35K. In this embodiment, it is moved in a counter-clockwise direction in FIG. 1, by a rotative force of the driving roller 32 which is rotationally driven in the counter-clockwise direction of the illustration by a driving unit M1.

The primary transfer rollers 35Y, 35M, 35C, and 35K are formed in a manner that the intermediate transfer belt 31 to be moved in an endless loop form is put between the rollers and the photosensitive elements 2Y, 2M, 2C, and 2K. Thus, primary transfer nips N1 for Y, M, C, and K are formed, and are in contact with the top surface of the intermediate transfer belt 31 and the photosensitive elements 2Y, 2M, 2C, and 2K. To the primary transfer rollers 35Y, 35M, 35C, and 35K, a primary transfer bias is applied by a primary transfer bias supply (not illustrated). As a result, a transfer field is formed between Y, M, C, and K toner images on the photosensitive elements 2Y, 2M, 2C, and 2K and the primary transfer rollers 35Y, 35M, 35C, and 35K. The Y toner formed on the surface of the photosensitive element 2Y for Y enters the primary transfer nip N1 for Y in accordance with the rotation of the photosensitive element 2Y. By the effects of the transfer field and the nip pressure, the toner is moved and primarily transferred from the photosensitive element 2Y onto the intermediate transfer belt 31. In this manner, the intermediate transfer belt 31 onto which the Y toner image has been primarily transferred sequentially passes through the primary transfer nips N1 for M, C, and K. The M, C, and K toner images on the photosensitive elements 2M, 2C, and 2K are superimposed sequentially on the Y toner image, to primarily be transferred. By the primary transfer of the superimposition, a four-color-superimposed toner image is formed on the intermediate transfer belt 31.

The primary transfer rollers 35Y, 35M, 35C, and 35K are formed of core metal and a conductive sponge layer which is fixed thereon. The primary transfer rollers 35Y, 35M, 35C, 35K are arranged in positions where their axes are deviated respectively approximately by 2.5 [mm] with respect to the axes of the photosensitive elements 2Y, 2M, 2C, and 2K, toward the downstream side in a belt movement direction. In this printer, to these primary transfer rollers 35Y, 35M, 35C, and 35K, a primary transfer bias is applied under the constant-current control. As the primary transfer member, a transfer charger or transfer brush may be used, in place of the primary transfer rollers 35Y, 35M, 35C, and 35K.

The nip-forming roller 36 included in the transfer unit 30 is arranged outside the loop of the intermediate transfer belt 31, and is formed in a manner that the intermediate transfer belt 31 is put between the nip-forming roller 36 and the secondary transfer back-surface roller 33 inside the loop. In this structure, a secondary transfer nip N is formed in contact with the top surface of the intermediate transfer belt 31 and the nip-forming roller 36. In the examples of FIG. 1 and FIG. 2, the nip-forming roller 36 is grounded, while the secondary transfer back-surface roller 33 is subject to a secondary transfer bias as a voltage by a power supply 39 which outputs a secondary transfer bias. As a result, a secondary transfer field is formed between the secondary transfer back-surface roller 33 and the nip-forming roller 36. This secondary transfer field is for electrostatically moving the negative polarity toner from the secondary transfer back-surface roller 33 to the nip-forming roller 36. In this embodiment, near the surface of the nip-forming roller 36, a protective agent applying unit 40B and a cleaning blade 41B as a cleaning member are formed. The protective agent applying unit 40B includes a protective agent 42B and a protective agent supply roller 43B. The protective agent supply roller 43B comes in contact with the top surface of the nip-forming roller 36 in a position opposed to the nip-forming roller 36, and comes in press-contact with the protective agent 42B. The cleaning blade 41B is arranged in contact with the surface of the nip-forming roller 36.

The paper cassette 100 which contains a bunch of stacked recording members P is provided below the transfer unit 30. The paper cassette 100 makes the top recording member P of the bunch of sheets in contact with a paper-feeding roller 100*a*, and rotationally drives it at a predetermined timing, thereby sending the recording member P toward a paper-feeding path. Near the end part of the paper feeding path, a pair of resistration rollers 101 is arranged. The resistration rollers 101 stop the rotation of both rollers, immediately after the recording member P sent from the paper cassette 100 is put between the rollers. The rotational driving is restarted, at a timing that the put recording member P is synchronized with the four-color-superimposed toner image on the intermediate transfer belt 31 inside the secondary transfer nip N. Then, the recording member P is sent toward the secondary transfer nip N. The four-color-superimposed toner image on the intermediate transfer belt 31, which is adhered to the recording member P with the secondary transfer nip N, is secondarily transferred at once onto the recording member P by the effects of the secondary transfer field or the nip pressure. As a result, the transferred toner image will be a full color toner image together with white color. In this manner, the recording member P having a full-color toner image formed thereon passes through the secondary transfer nip N, and then self-strips from the nip-forming roller 36 or the intermediate transfer belt 31.

The secondary transfer back-surface roller 33 includes core metal and a conductive NBR rubber layer covering the surface thereof. The nip-forming roller 36 also includes core metal and a conductive NBR rubber layer covering the surface thereof.

The power supply 39 is to output a voltage (hereinafter referred to as a "secondary transfer bias") for transferring the toner image on the intermediate transfer belt 31 onto the recording member P which is put in the secondary transfer nips. The power supply 39 has a DC power supply and an AC power supply, and is configured to output a superimposed bias in which an AC voltage is superimposed on a DC voltage, as a secondary transfer bias. In this embodiment, as illustrated in FIG. 1, a secondary transfer bias is applied to the secondary transfer back-surface roller 33, and the nip-forming roller 36 is grounded.

Figure 3:
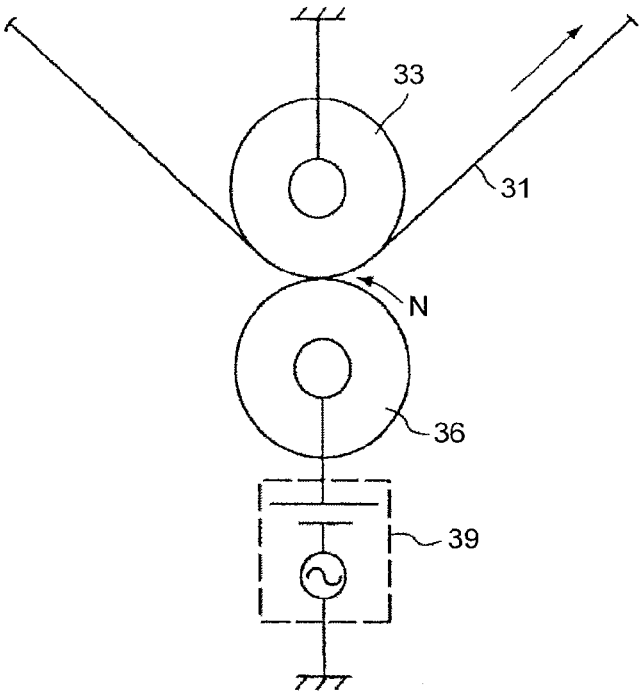
FIG. 3 is an enlarged diagram illustrating an example of a power supply and voltage supply for secondary transfer, for use in the image forming apparatus.

The technique of supplying a secondary transfer bias is not limited to that of FIG. 1. As illustrated in FIG. 3, while a superimposed bias from the power supply 39 is applied to the nip-forming roller 36, the secondary transfer back-surface roller 33 may be grounded. In this case, the polarity of the DC voltage is changed. As illustrated in FIG. 1, in a condition that the negative polarity toner is used and the nip-forming roller 36 is grounded, when a superimposed bias is applied to the secondary transfer back-surface roller 33, the potential of the time average of the superimposed bias is made to be the same negative polarity as that of the toner, using a DC voltage of the same negative polarity as that of the toner.

Like the technique illustrated in FIG. 3, when the secondary transfer back-surface roller 33 is grounded, and when the superimposed bias is applied to the nip-forming roller 36, the potential of the time average of the superimposed bias is made to be the polarity opposite to that of the toner, that is, the positive polarity, using a DC voltage of the opposite polarity to that of the toner.

Figure 4:
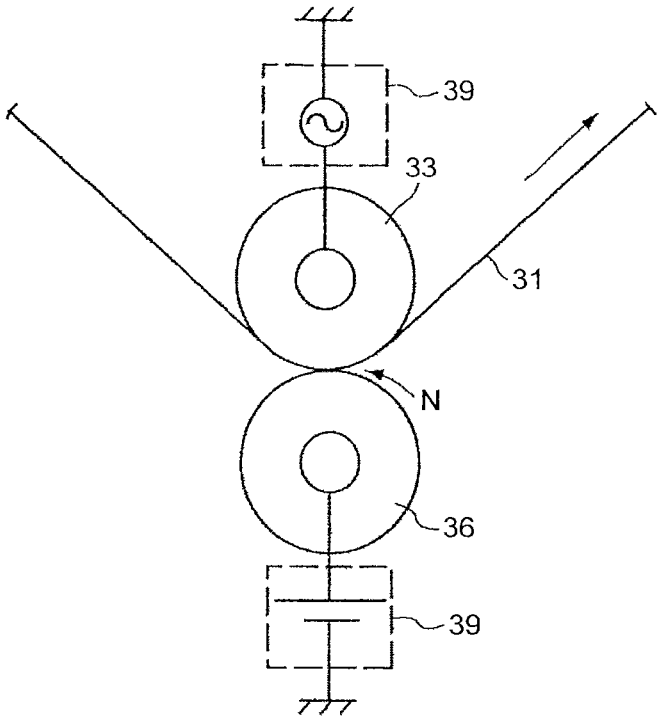
FIG. 4 is an enlarged diagram illustrating another example of a power supply and voltage supply for secondary transfer, for use in the image forming apparatus.
Figure 5:
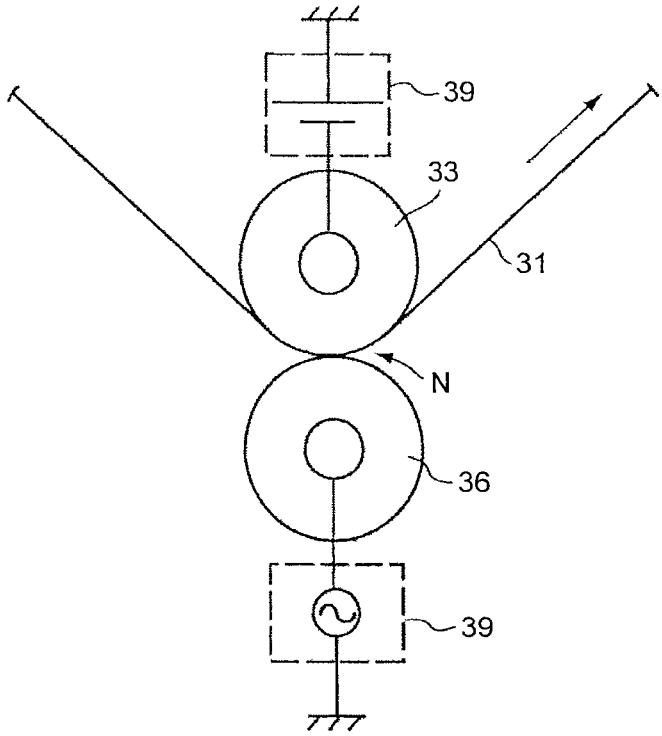
FIG. 5 is an enlarged diagram illustrating still another example of a power supply and voltage supply for secondary transfer, for use in the image forming apparatus.

The technique of supplying a superimposed bias as a secondary transfer bias is not limited to the method of applying the bias to either one of the secondary transfer back-surface roller 33 and the nip-forming roller 36. For example, as illustrated in FIG. 4 and FIG. 5, a DC voltage may be applied from the power supply 39 to one of the rollers, and an AC voltage may also be applied from the power supply 39 to the other roller.

Figure 6:
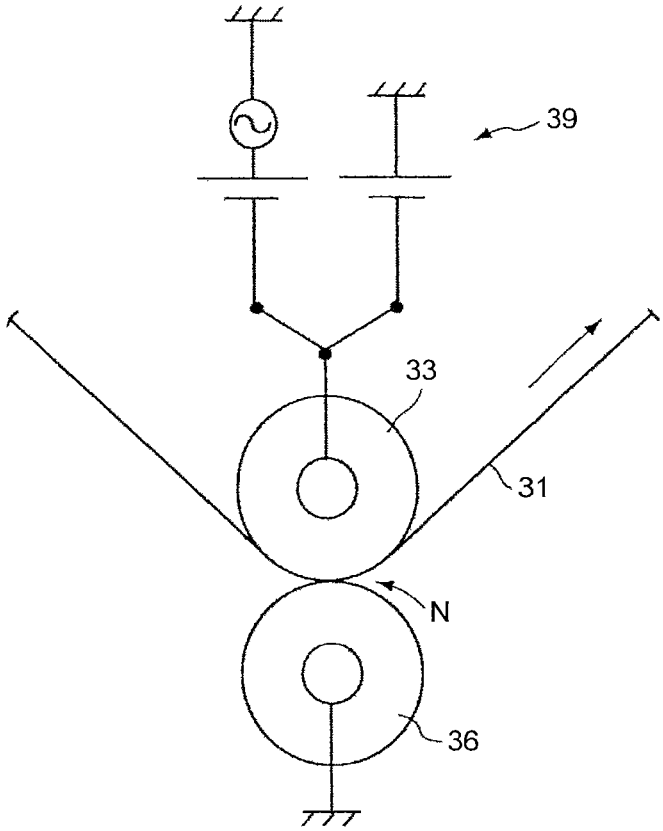
FIG. 6 is an enlarged diagram illustrating still yet another example of a power supply and voltage supply for secondary transfer, for use in the image forming apparatus.
Figure 7:
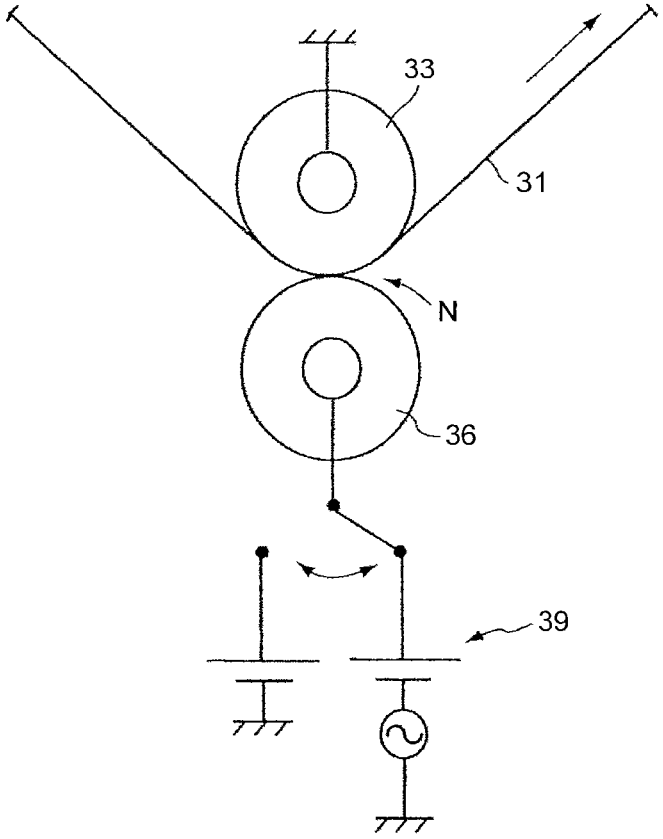
FIG. 7 is an enlarged diagram illustrating further example of a power supply transfer and voltage supply for secondary transfer, for use in the image forming apparatus.

The technique of supplying a secondary transfer bias is not limited to the above. As illustrated in FIG. 6 and FIG. 7, both "DC voltage+AC voltage" and "DC voltage" may be switched one from another to be supplied to only one of the rollers. In the example illustrated in FIG. 6, the "DC voltage+AC voltage" and the "DC voltage" are switched one from another to be supplied from the power supply 39 to the secondary transfer back-surface roller 33. In the example illustrated in FIG. 7, the "DC voltage+AC voltage" and the "DC voltage" are switched one from another to be supplied from the power supply 39 to the nip-forming roller 36.

Figure 8:
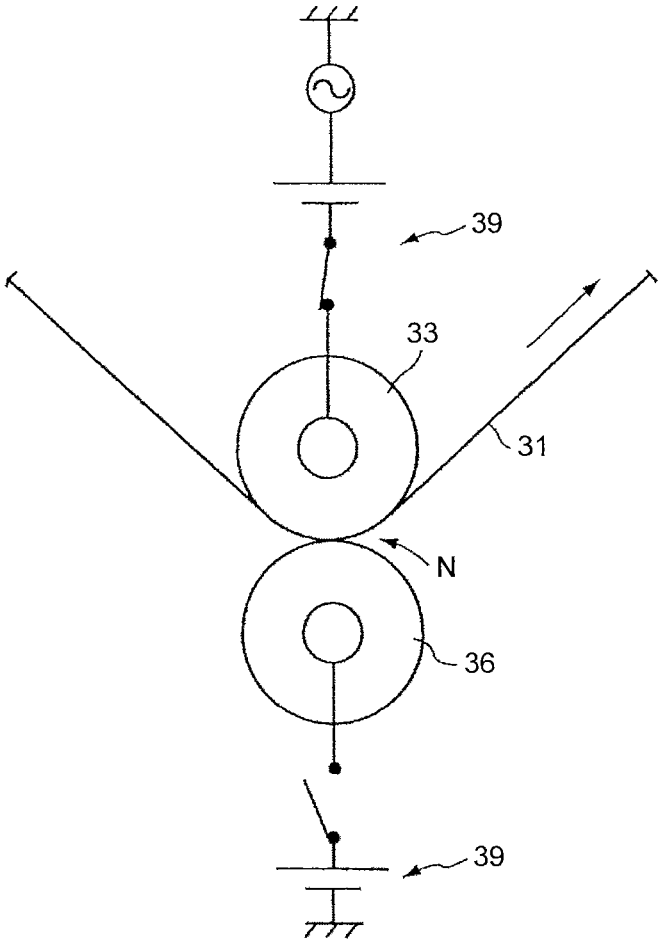
FIG. 8 is an enlarged diagram illustrating still further example of a power supply and voltage supply for secondary transfer, for use in the image forming apparatus.
Figure 9:
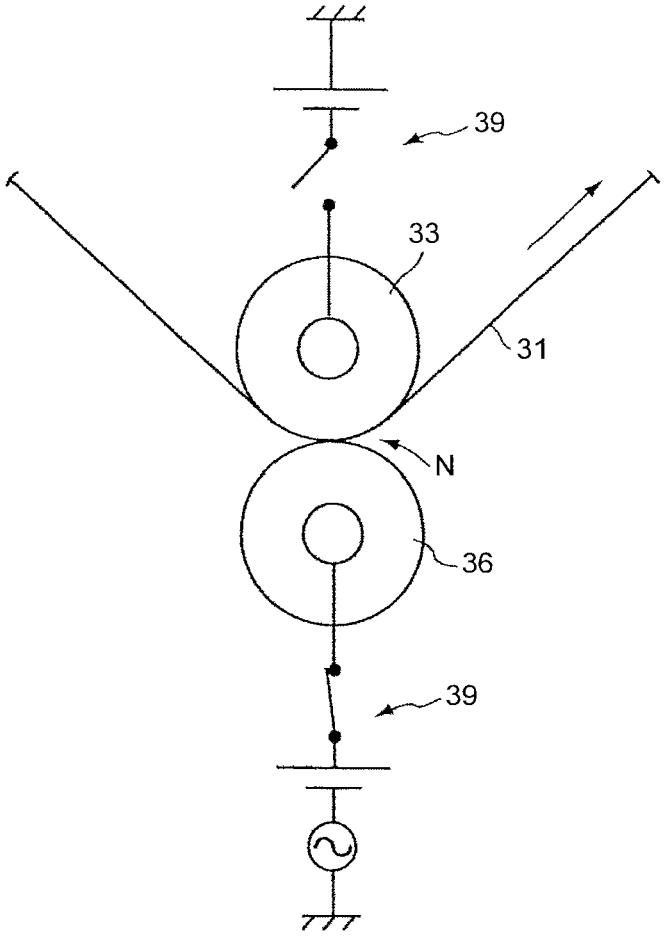
FIG. 9 is an enlarged diagram illustrating still yet further example of a power supply and voltage supply for secondary transfer, for use in the image forming apparatus.

As the technique of supplying the secondary transfer bias, the "DC voltage+AC voltage" and the "DC voltage" may be switched one from another. In this case, as illustrated in FIG. 8 and FIG. 9, the voltages to be supplied may be switched one from another. That is, the "DC voltage+AC voltage" may be supplied to one of the rollers, and the "DC voltage" may be supplied to the other roller. In the example illustrated in FIG. 8, the "DC voltage+AC voltage" can be supplied to the secondary transfer back-surface roller 33, while the DC voltage can be supplied to the nip-forming roller 36. In the form illustrated in FIG. 9, a "DC voltage" can be supplied to the secondary transfer back-surface roller 33, while a "DC voltage+AC voltage" can be supplied to the nip-forming roller 36.

As described above, various methods are provided for supplying a secondary transfer bias to the secondary transfer nip N. A provided power supply may be the one that can supply the "DC voltage+AC voltage", like the power supply 39. Other than this power supply, any method may appropriately be selected in accordance with the method of supplying the voltage, for example, a method for individually supplying the "DC voltage" and the "AC voltage", and a method for supplying the "DC voltage+AC voltage" and the "DC voltage" through one power supply. The power supply 39 for the secondary transfer bias is configured to switch between a first mode and a second mode. In the first mode, only a DC voltage is output. In the second mode, an AC voltage superimposed on a DC voltage (superimposed voltage) is output. In the technique of FIG. 1, FIG. 3 to FIG. 5, the output of the AC voltage is ON/OFF, thereby enabling to switch between the two modes. In the technique illustrated in FIG. 6 to FIG. 9, two power supplies are provided using a switching system with a relay function, and the two power supplies are selectively switched, thereby switching between the modes.

For example, as a recording member P, plain paper with an even surface may be used, instead of coarse paper with an uneven surface. In this case, a gray-scale pattern does not appear in accordance with the uneven pattern. Thus, a bias with only a DC voltage is applied as a secondary transfer bias in the first mode. When paper with an uneven surface, such as coarse paper, is used, an AC voltage superimposed on a DC voltage is output as a secondary transfer bias in the second mode. That is, the secondary transfer bias may be output in the first mode or the second mode which are switched one from another, in accordance with the kind of the recording member (surface unevenness level of the recording member).

As illustrated in FIG. 1, residual toner without being transferred onto the recording member P is attached onto the intermediate transfer belt 31 after passed through the secondary transfer nip N. The residual toner is cleaned from the belt surface by the cleaning blade 37 in contact with the top surface of the intermediate transfer belt 31. The cleaning backup roller 34 arranged inside the loop of the intermediate transfer belt 31 is to back up the cleaning of the belt by the cleaning blade 37 from the inside of the loop.

The fixing device 90 is arranged on the right side in the illustration sheet of FIG. 1, as the downstream side of the transfer direction of the recording member with respect to the secondary transfer nip N. The fixing device 90 forms a fixing nip, using a fixing roller 91 and a pressure roller 92. The fixing roller 91 includes a heat source, such as a halogen lamp. The pressure roller 92 rotates in contact with the fixing roller 91 using a predetermined pressure. The recording member P sent into the fixing device 90 is put in the fixing nip, in a posture that the surface supporting an unfixed toner image is adhered to the fixing roller 91. The toner of the toner image is softened due to the heat or pressure, resulting in fixing a full-color image. The recording member P discharged from the fixing device 90 passes through the transfer path after being fixed, thereafter being externally discharged.

In this printer, a normal mode, a high image quality mode, a high-speed mode are set in the control unit 60. The process linear velocity (linear velocity of the photosensitive element or the intermediate transfer belt) in the normal mode is set approximately at 280 [mm/s]. The process linear velocity, in the high image quality mode in which high image quality takes precedence over the print velocity, is set at a slower value than that in the normal mode. The process linear velocity, in the high-speed mode in which the print velocity takes precedence over image quality, is set at a higher value than that in the normal mode. The normal mode, the high image quality mode, and the high-speed mode are switched one from another in accordance with a user key operation on an operation panel (not shown) provided in the printer or a printer property menu on the personal computer connected to the printer.

In this printer, when a monochrome image is formed, a swingable supporting plate (not illustrated) is moved. This supporting plate supports the primary transfer rollers 35Y, 35M, and 35C for Y, M, and C in the transfer unit 30. The primary transfer rollers 35Y, 35M, and 35C are kept away from the photosensitive elements 2Y, 2M, and 2C. As a result, the top surface of the intermediate transfer belt 31 is pull apart from the photosensitive elements 2Y, 2M, and 2C, and the intermediate transfer belt 31 is in contact only with the photosensitive element 2K for K. In this state, of the four image forming units 1Y, 1M, 1C, and 1K, only the image forming unit 1K for K is driven to form a K toner image on the photosensitive element 2K.

In this printer, a DC component of the secondary transfer bias has the same value as the time average value (Vave) of a voltage, that is, the same value as the time average voltage value (time average value) Vave that is a voltage of the DC component. The time average value Vave of the voltage is a resultant value obtained by dividing an integrated value over one cycle of a voltage waveform by the length of one cycle.

In this printer in which a secondary transfer bias is applied to the secondary transfer back-surface roller 33 and the nip-forming roller 36 is grounded, the polarity of the secondary transfer bias may be the same as the polarity of the toner, that is, the negative polarity. At this time, the toner with the negative polarity is electrostatically pushed out from the secondary transfer back-surface roller 33 to the nip-forming roller 36, in the secondary transfer nip N. As a result, the toner on the intermediate transfer belt 31 is transferred onto the recording member P. When the polarity of the superimposed bias is opposite (the positive polarity) to that of the toner, the toner with the negative polarity is electrostatically attracted from the nip-forming roller 36 to the secondary transfer back-surface roller 33. Then, the toner transferred to the recording member P is attracted again onto the intermediate transfer belt 31.

Meanwhile, as the recording member P, if a member (such as Japanese paper) having an uneven surface is used, a gray-scale pattern corresponding to the surface uneven pattern can easily be made in the image. Thus, in Japanese Patent Application Laid-open No. 2006-267486, a superimposed bias in which a DC voltage is superimposed on an AC voltage is applied as a secondary transfer bias, instead of the one including only the DC voltage.

Figure 10:
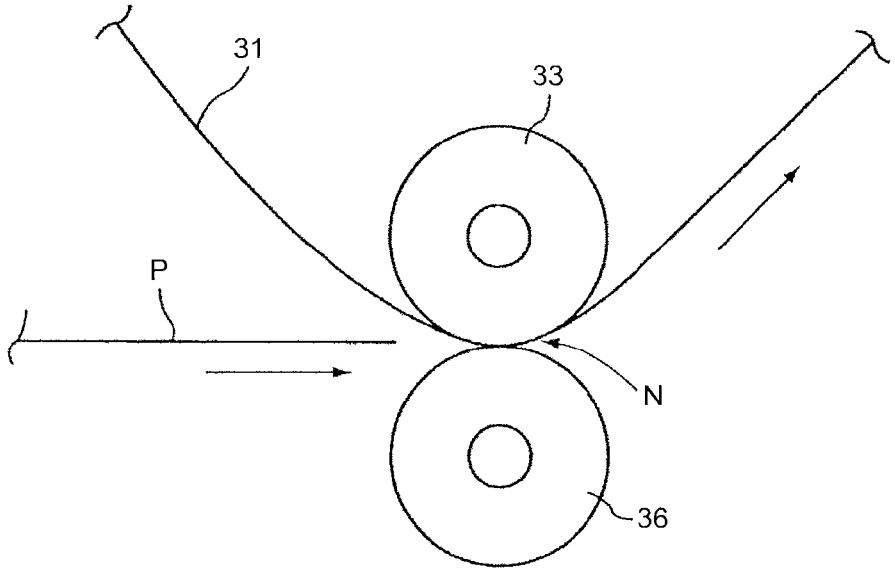
FIG. 10 is an enlarge block diagram illustrating an example of a secondary transfer nip.

FIG. 10 is a schematic diagram schematically illustrating an example of a secondary transfer nip N. In FIG. 1, the intermediate transfer belt 31 is pressed toward the nip-forming roller 36 by the secondary transfer back-surface roller 33 being in contact with the back surface thereof. With this pressing, a secondary transfer nip N is formed. This nip is in contact with the top surface of the intermediate transfer belt 31 and the nip-forming roller 36. A toner image on the intermediate transfer belt 31 is secondarily transferred onto the recording member P which is sent to the secondary transfer nip N. A secondary transfer bias for secondarily transferring the toner image is applied to one of the two rollers illustrated in the illustration, while the other roller is grounded. The toner image can be transferred onto the recording member P, by applying the secondary transfer bias to any of the rollers. Descriptions will now be made to a case where a secondary transfer bias is applied to the secondary transfer back-surface roller 33, and a toner with the negative polarity is used. In this case, to move the toner in the secondary transfer nip N from the secondary transfer back-surface roller 33 to the nip-forming roller 36, as a secondary transfer bias including a superimposed bias, a bias is applied that the time average value of the potential will be the same polarity as that of the toner, that is, the negative polarity.

Figure 11:
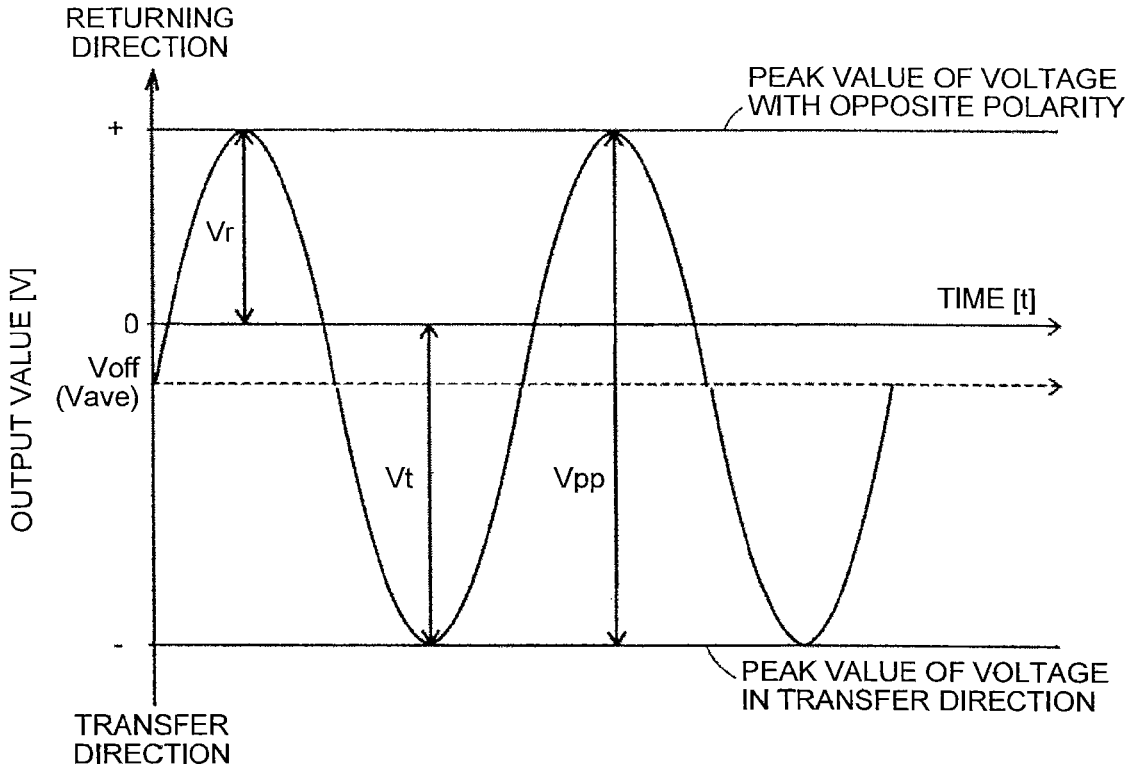
FIG. 11 is a waveform diagram in a case where a voltage including a superimposed bias has a sine waveform.

FIG. 11 is a diagram illustrating an example of a waveform of a secondary transfer bias, to be applied to the secondary transfer back-surface roller 33 and including a superimposed bias. In FIG. 11, the time average voltage (hereinafter referred to as "time average value") Vave [V] represents the time average value of the secondary transfer bias. As illustrated in FIG. 11, a secondary transfer bias including a superimposed bias shows a sine waveform, and includes a peak value of a voltage on the side of a returning direction (opposite direction) and a peak value of a voltage on the side of a transfer direction. A symbol "Vt" is attached to the peak value of voltage (hereinafter referred to as "transfer direction peak value Vt") on the side of the transfer direction (transfer direction side), which enables transfer of the toner in the secondary transfer nip N from the belt side to the nip-forming roller 36. A symbol "Vr" is attached to the peak value of voltage (hereinafter referred to as "returning peak value Vr") on the side of the returning direction (returning direction side), which enables return of the toner from the nip-forming roller 36 onto the belt side. Instead of the illustrated superimposed bias, the toner in the secondary transfer nip N can be moved in both ways back and forth between the belt and the recording member, by applying an AC bias including only an AC component. With the AC bias, the toner may not be transferred onto the recording member P simply by moving the toner back and forth. By applying a superimposed bias including a DC component, the time average voltage Vave [V] as its time average value is the same polarity as that of the toner, that is, the negative polarity. As a result, while the toner is moved back and forth, it can be transferred relatively from the belt to the recording member.

Figure 12:
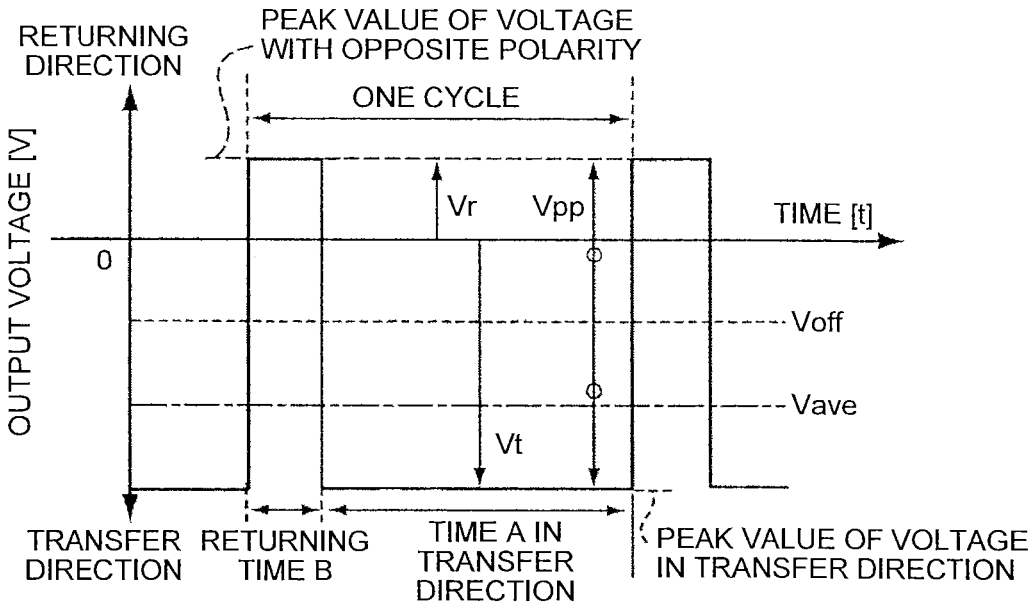
FIG. 12 is a waveform diagram in a case of a square wave of a voltage including a superimposed bias.

To enhance the transferability of toner to the paper having an uneven surface, a secondary transfer bias with an AC waveform may be applied, as illustrated in FIG. 12. In the waveform, a time B in the returning direction is shorter than a time A in the transfer direction. The secondary transfer bias illustrated in FIG. 12 illustrates a case of a square wave. In this manner, as the waveform of the secondary transfer bias, the sine wave illustrated in FIG. 11 is not limited, and the square wave of FIG. 12 may be used.

In this embodiment, it is essential that an alternating electric field is applied as a secondary transfer bias, and the protective agent 22K for the photosensitive element 2K includes at least both of zinc stearate and boron nitride. Boron nitride used in the protective agent 22K is preferably in a range from 0.1 to 14.0 μm. Particles of metal oxide, such as silica and alumina, may be added therewith. The percentages of mixing the above materials are: preferably 95% to 60% of zinc stearate; 5% to 40% of boron nitride; and additionally 1% to 10% of alumina. Further, more preferably, the percentages are: 90% to 80% of zinc stearate; 10% to 20% of boron nitride; and additionally 2% to 6% of alumina.

In this embodiment, the protective agent 22K is preferably made in a block-like form extending along the bus direction (axis direction) of the photosensitive element 2K. The agent may be used in the form of powder as is. However, the supply amount of the agent can be easily controlled, if it is used in the block-like form.

The method of molding the agent in a block-like form may include mixing/melting of zinc stearate and boron nitride for use in the present invention, pouring of them into a mold, and cooling of it, thereby forming the block-like protective agent. Alternatively, the method may include compression molding of mixed powders in a mold.

Further, the protective agent 22 (22Y, 22M, 22C, 22K) is compression molded. The protective agent 22 includes at least zinc stearate and boron nitride, and is applied to each photosensitive element. The protective agent 42A and the protective agent 42B are preferably melted to be formed. This protective agent 42A is applied to the intermediate transfer belt 31, and the protective agent 42B includes at least zinc stearate and is applied to the nip-forming roller 36.

Figure 13:
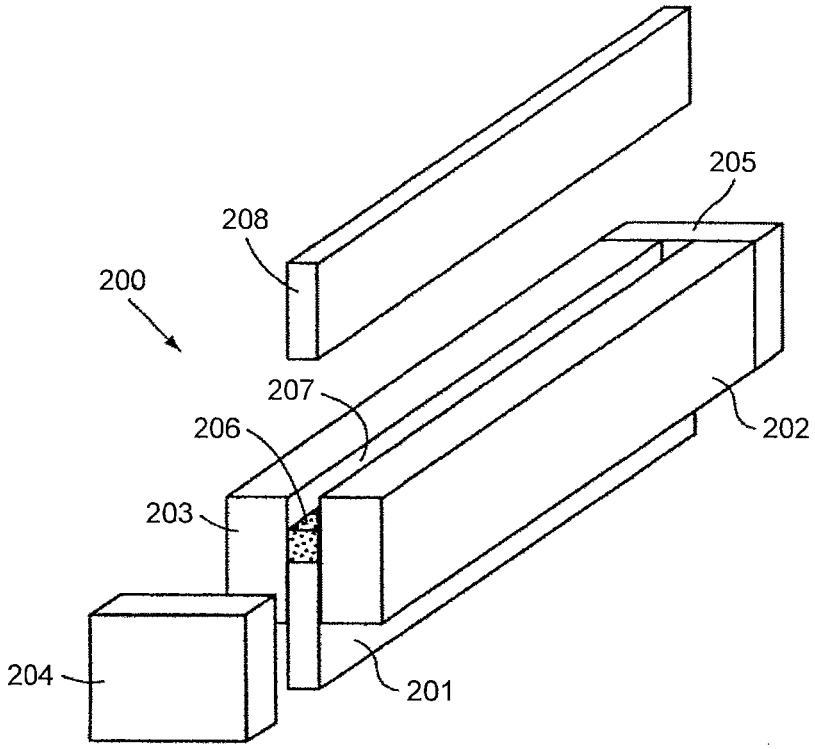
FIG. 13 is a perspective diagram illustrating an example of a mold for manufacturing a protective agent.

The compression molding method will now schematically be described. FIG. 13 is a diagram illustrating a general view of a mold 200 to be used in this embodiment. The mold 200 includes a female mold 201 extending along the longitudinal direction, horizontal molds 202 and 203 arranged on the side surface of it, and also end molds 204 and 205. The end molds 204 and 205 are longitudinally positioned at and connected to both ends of the female mold 201 and the horizontal molds 202 and 203. Then, raw materials 206 before being compressed are poured into a space 207 put between the molds, and a male mold 208 extending along the longitudinal direction is moved and pressed into the space 207.

Figure 14A:
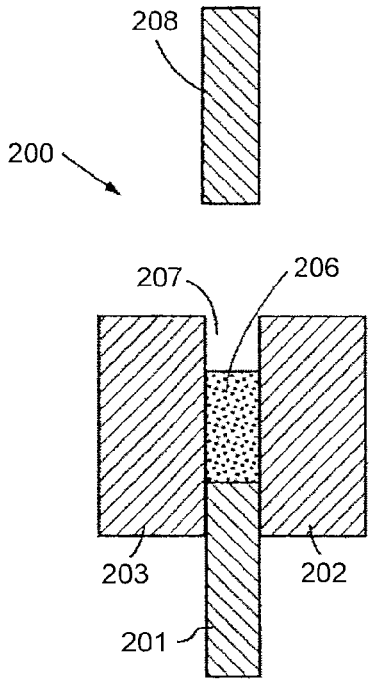
FIGS. 14A to 14C are schematic cross sectional views illustrating manufacturing steps of the protective agent.
Figure 14B:
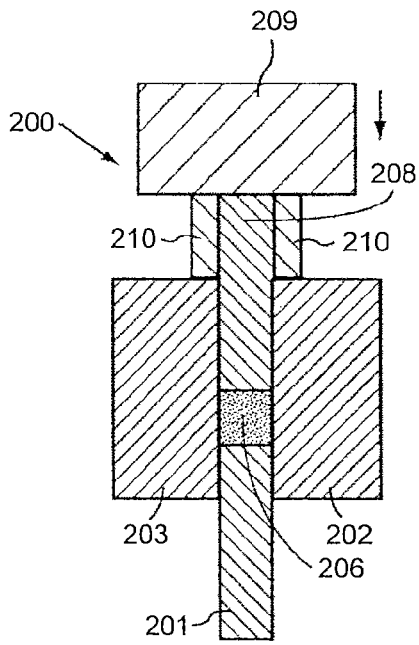
Figure 14C:
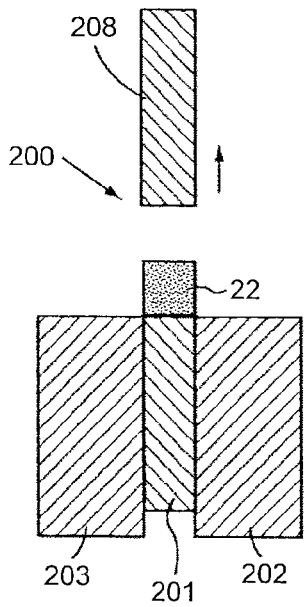

FIGS. 14A to 14C are schematic cross sectional views of the mold 200 seen from the longitudinal direction. FIG. 14A illustrates a state of the mold before compression, FIG. 14B illustrates a compression state, and FIG. 14C illustrates a separation state. First, as illustrated in FIG. 14A, while the male mold 208 stands by above the space 207, the raw materials 206 are poured into the space 207. As illustrated in FIG. 14B, the male mold 208 is held by holding units 210 of a movable part 209 and moved into the space 207, thereby pressing the raw materials 206. After this pressing, as illustrated in FIG. 14C, the male mold 208 is moved upward, and the female mold 201 is moved upward in the space 207, thereby pushing out and taking out the block protective agent 22 (Y, M, C, and K).

The cleaning blades 21K, 37, and 41B, and the materials of the blade used in the applying blade 5K are not limited to the above. As materials for a cleaning blade, examples of generally known elastic bodies are urethane rubber, hydrin rubber, silicon rubber, and fluorocarbon rubber. At this time, the elastic bodies may singly be used, or may be blended with other elastic bodies. These rubber blades have a part, which is in contact with each photosensitive element and may be coated or impregnated with a low friction coefficient material. To adjust the hardness of the elastic body, some filling materials (typically organic filler and inorganic filler) may be scattered.

Each of the cleaning blade 21K and the applying blade 5K is fixed by using an arbitrary method (adhesion or fusion) onto the blade supporting body, in a manner that its tip end part comes in press-contact with the surface of each photosensitive element. The thickness of the blades cannot unambiguously be defined in view of the applied pressing force. However, the blades can preferably be used if their thickness is approximately from 0.5 to 5 mm, and can more preferably be used if their thickness is approximately 1 to 3 mm.

The length (so-called the free length) of the cleaning blade, projecting from the supporting body of the blade and being flexible, cannot also unambiguously be defined in view of the applied pressing force. The blade can preferably be used if its length is approximately 1 to 15 mm, and can more preferably be used if its length is approximately 2 to 10 nm.

The pressing force of the cleaning blade 21K and the applying blade 5K onto each photosensitive element is sufficient as long as the protective agent 22K spreads to be in a state of a projective layer or a protective film. For example, the linear pressure is preferably in a range equal to or higher than 5 gf/cm and equal to or lower than 80 gf/cm, and more preferably in a range equal to or higher than 10 gf/cm and equal to or lower than 60 gf/cm. The member in a brush form is preferably used as a supplying member of the protective agent. In this case, the bush fibers preferably have flexibility to restrain mechanical stress onto the surface of the photosensitive element.

As a specific material of the flexible brush fibers, one or two kinds of materials can be selected from generally known materials. Specifically, some resins having flexibility can be selected, from polyolefin resin (for example, polyethylene, polypropylene); polyvinyl and polyvinylidene resin (for example, polystyrene, acrylic resin, polyacrylonitrile, polyvinyl acetate, polyvinyl alcohol, polyvinyl butylal, polyvinyl chloride, polyvinyl carbazole, polyvinyl ether, and polyvinylketone); vinyl chloride-vinyl acetate copolymer; styrene-acrylic acid copolymer; styrene-butadiene resin; fluorocarbon resin (for example, polytetrafluoroethylene, polyvinyl fluoride, polyvinylidene fluoride, and polychloro-trifluoroethylene); polyester; nylon; acryl; rayon; polyurethane;

polycarbonate; phenol resin; amino resin (for example, formaldehyde resin, melamine resin, benzoguanamine resin, urea resin, and polyamide resin).

To adjust the degree of flexibility, diene rubber, styrene-butadiene rubber (SBR), ethylene propylene rubber, isoprene rubber, nitrile rubber, urethane rubber, silicone rubber, hydrin rubber, and polynorbornene rubber, may be compounded.

In this embodiment, as a supply member of the protective agent 22, the protective agent supply roller 4K having a foaming elastic layer 44K is used, other than the brush. The roller material is preferably polyurethane foam.

There are two methods for manufacturing the protective agent supply roller 4K, as will now be described. In one method, polyurethane foam is made in a block-like form, as an elastic layer using a polyurethane foam material, the block is cut out in a required form, and its surface is polished. Then, the block is processed in a roller form having a cell whose surface is open, and core metal is inserted therein. In the other method, a polyurethane foam material is poured into a protective agent supply roller formation mold including core metal, to foam/harden the material. The method for manufacturing the protective agent supply roller 4K is not limited to these.

The number of cells and hardness of the foaming elastic layer (as the protective agent supply roller 4K of this embodiment) are not particularly limited, as long as the object of the present invention is attained. From an aspect that relatively small particles and uniform protective agent particles are supplied to the image carrier, the number of cells is preferably 20 to 300 per 25 cm, and more preferably 60 to 300 per 25 cm, while the hardness is preferably 40 to 430 N, and more preferably 40 to 300 N.

By adjusting the number of cells and hardness of the foaming elastic layer, it is possible to control the particle diameter of the particles of the protective agent 22K including a solid lubricant and supplied onto the surface of the photosensitive element. For example, if the number of cells is increased or the hardness is decreased, the particle diameter of the protective agent particles gets smaller. However, the force of the roller grinding the protective agent block is very little, and the amount of grinding the protective agent block is very small.

The descriptions have been made to the arrangement conditions and manufacturing methods of the protective agent, the cleaning blades, and the applying blades, for mainly black. The same arrangement conditions and manufacturing methods are used for protective agents 22Y, 22M, 22C, cleaning blades 21Y, 21M, 21C, and applying blades 5Y, 5M, and 5C for yellow, magenta, and cyan, as those for black.

Now, what will be described is the experimentation for illustrating the effect of this embodiment and its results.

In this embodiment (the present invention), to transfer a toner image formed on the intermediate transfer belt 31 onto a recording member P, the voltage (secondary transfer bias) is alternatively switched in the transfer direction and in the returning direction (opposite direction). As described above, the voltage in the transfer direction enables transfer of the toner image from the intermediate transfer body to the recording member, and the voltage in the opposite direction has polarity opposite to polarity of the voltage in the transfer direction. Furthermore, a protective agent including at least both of zinc stearate and boron nitride is applied to the photosensitive element.

In the following experimentation, the following two kinds of protective agents were used.

Protective agent A: using zinc stearate as conventionally used for protective agent. In this experimentation, 100% of [GF200 (Nippon Oil & Fats Co., Ltd.)] was used with a melt/molding technique.

Protective agent B: using both zinc stearate and boron nitride, as required in the present invention. In this experimentation, 76% of [GF200 (Nippon Oil & Fats Co., Ltd.)], 19% of [NX5 (Momentive Performance Materials Inc.)], and 5% of [Sumitomo Chemical Co., Ltd.], were all mixed together and compression molded.

In the experimentation, as the bias to be applied to the secondary transfer nip N, three kinds of biases were used.

DC: transfer bias having only a DC component, as conventionally used.

Sine wave: using a sine wave illustrated in FIG. 11, as an AC component, and superimposed on the DC component.

Low duty wave: using a waveform illustrated in FIG. 12, as an AC component, and superimposed on the DC component.

The experimentation was performed as follows at a part of a zinc stearate block in the cleaning unit of the photosensitive element, in an imaging unit of "imajio MP C7500" (RICOH). The protective agent 22 of this embodiment was supplied. A power pack of the product is removed. A waveform of the bias was created by an external function generator (FG300 by YOKOGAWA ELECTRIC). This bias was amplified by 1000 times by an amplifier (Trek High Voltage Amplifier Model 10/40), and applied in the secondary transfer nip N.

The process linear velocity, which is the linear velocity of each photosensitive element and the intermediate transfer belt 31, was set at 173 [mm/s]. The frequency "f" of an AC component of the secondary transfer bias was set at 500[Hz].

As a recording member P, 175 kg paper (paper size 127×188 mm: ream weight) "LEATHAC 66" (TOKUSHU PAPER MFG CO., LTD.) was used. LEATHAC 66 is a kind of paper with a larger uneven surface than that of "Sazanami". The depth of the concaved part in the uneven surface of paper was 100 [μm] at maximum. The test atmosphere was 10° C. and 15%.

2000 sheets each bearing a solid image formed thereon as an image pattern were output. At this time, the cleaning performance was evaluated, and the results are shown in Table 1.

TABLE 1

| | Protective Agent A | | | | |
|---|---|---|---|---|---|
| | Photosensitive element | Intermediate Transfer | Secondary Transfer | Transfer Bias | Cleaning Performance |
| Comparative Example 1 | Protective Agent A | None | None | DC | ◎ |
| Comparative Example 2 | Protective Agent A | Protective Agent A | Protective Agent A | DC | ◎ |

TABLE 1-continued

| | Protective Agent A | | | | |
|---|---|---|---|---|---|
| | Photosensitive element | Intermediate Transfer | Secondary Transfer | Transfer Bias | Cleaning Performance |
| Comparative Example 3 | Protective Agent A | None | None | Sine Wave | Δ |
| Comparative Example 4 | Protective Agent A | Protective Agent A | Protective Agent A | Sine Wave | Δ |
| Comparative Example 5 | Protective Agent A | None | None | Low Duty Wave | X |
| Comparative Example 6 | Protective Agent A | Protective Agent A | Protective Agent A | Low Duty Wave | X |
| Example 1 | Protective Agent B | None | None | Sine Wave | ◎ |
| Example 2 | Protective Agent B | Protective Agent A | Protective Agent A | Sine Wave | ◎ |
| Example 3 | Protective Agent B | None | None | Low Duty Wave | ◎ |
| Example 4 | Protective Agent B | Protective Agent A | Protective Agent A | Low Duty Wave | ◎ |

COMPARATIVE EXAMPLE 1

As a protective agent, the protective agent A was applied to each photosensitive element, but no application was made to the intermediate transfer belt 31 and the nip-forming roller 36. A secondary transfer bias having only a DC component was applied.

COMPARITIVE EXAMPLE 2

As a protective agent, the protective agent A was applied to each photosensitive element, and also applied to the intermediate transfer belt 31 and the nip-forming roller 36. A secondary transfer bias having only a DC component was applied.

COMPARATIVE EXAMPLE 3

As a protective agent, the protective agent A was applied to each photosensitive element, and no application was made to the intermediate transfer belt 31 and the nip-forming roller 36. A secondary transfer bias having a sine wave of FIG. 11 was applied.

COMPARITIVE EXAMPLE 4

As a protective agent, the protective agent A was applied to each photosensitive element, and applied to the intermediate transfer belt 31 and the nip-forming roller 36. A secondary transfer bias having a sine wave of FIG. 11 was applied.

COMPARITIVE EXAMPLE 5

As a protective agent, the protective agent A was applied to each photosensitive element, and no application was made to the intermediate transfer belt 31 and the nip-forming roller 36. A secondary transfer bias having a low duty wave of FIG. 12 was applied.

COMPARITIVE EXAMPLE 6

As a protective agent, the protective agent A was applied to each photosensitive element, and also applied to the intermediate transfer belt 31 and the nip-forming roller 36. A secondary transfer bias having a low duty wave of FIG. 12 was applied.

EXAMPLE 1

As a protective agent, the protective agent B was applied to each photosensitive element, and no application was made to the intermediate transfer belt 31 and the nip-forming roller 36. A secondary transfer bias having a sine wave of FIG. 11 was applied.

EXAMPLE 2

As a protective agent, the protective agent B was applied to each photosensitive element, and also was applied to the intermediate transfer belt 31 and the nip-forming roller 36. A secondary transfer bias having a sine wave was applied.

EXAMPLE 3

As a protective agent, the protective agent B was applied to each photosensitive element, and no application was made to the intermediate transfer belt 31 and the nip-forming roller 36. A secondary transfer bias having a low duty wave of FIG. 12 was applied.

EXAMPLE 4

As a protective agent, the protective agent B was applied to each photosensitive element, while the protective agent A was applied to the intermediate transfer belt 31 and the nip-forming roller 36. A secondary transfer bias having a low duty wave of FIG. 12 was applied.

In the same experimentation, filming of the intermediate transfer belt 31 and the nip-forming roller 36 was checked. The filming implies a phenomenon that materials of a toner and the like are attached, thus resulting in an abnormal image. The results are shown in Table 2.

TABLE 2

| | Protective Agent A | | | | | |
|---|---|---|---|---|---|---|
| | Photosensitive element | Intermediate Transfer | Secondary Transfer | Transfer Bias | Intermediate Transfer Filming | Secondary Transfer Filming |
| Example 5 | Protective Agent B | Protective Agent A | None | Sine Wave | ◎ | ○ |
| Example 6 | Protective Agent B | None | Protective Agent A | Sine Wave | ○ | ◎ |
| Example 7 | Protective Agent B | Protective Agent A | None | Low Duty Wave | ◎ | Δ |

TABLE 2-continued

| | Protective Agent A | | | | Inter- | Secon- |
|---|---|---|---|---|---|---|
| | Photo-sensitive element | Inter-mediate Transfer | Secon-dary Transfer | Trans-fer Bias | mediate Transfer Filming | dary Trans-fer Film-ing |
| Exam-ple 8 | Protective Agent B | None | Protective Agent A | Low Duty Wave | Δ | ◎ |

EXAMPLE 5

As a protective agent, the protective agent B was applied to each photosensitive element, the protective agent A was applied to the intermediate transfer belt 31, and no application was made to the nip-forming roller 36. A sine wave of FIG. 11 as a secondary transfer bias was applied.

EXAMPLE 6

As a protective agent, the protective agent B was applied to each photosensitive element, and no application was made to the intermediate transfer belt 31 and the nip-forming roller 36. A sine wave of FIG. 11 as a secondary transfer bias was applied.

EXAMPLE 7

As a protective agent, the protective agent B was applied to each photosensitive element, the protective agent A was applied to the intermediate transfer belt 31, and no application was made to the nip-forming roller 36. A low duty wave of FIG. 12 as a secondary transfer bias was applied.

EXAMPLE 8

As a protective agent, the protective agent B was applied to each photosensitive element, and no application was made to the intermediate transfer belt 31 and the nip-forming roller 36. A low duty wave of FIG. 12 as a secondary transfer bias was applied.

Figure 15:
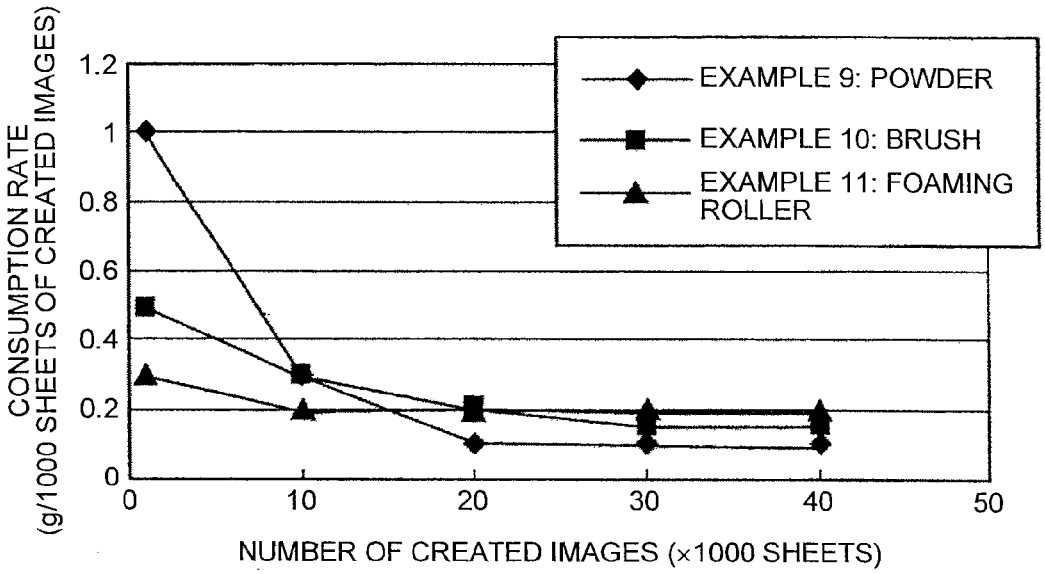
FIG. 15 is a diagram illustrating a transition of a protective agent supply method and a protective agent consumption rate.

As a comparison of the protective agent supplying method of this embodiment, a transition of a protective agent consumption rate for each protective agent supply method was checked. The results are shown in FIG. 15.

EXAMPLE 9

As a protective agent supply method, supplying of powder was used. Thus, the protective agent B was used in the form of powder.

EXAMPLE 10

As a protective agent supply method, a brush roller was used, that is, the brush used in the above "ImajioC7500" was used as is, and the protective agent B which was compression molded was used.

EXAMPLE 11

As a protective agent supply method, a roller of urethane foam was used, and the protective agent B which was compression molded was used.

In this embodiment of the present invention, an AC bias is applied to the secondary transfer nip N, thus stabilizing the density of the image. Even if an AC bias is applied to the secondary transfer nip N, it can be estimated that the cleaning performance can preferably be maintained.

In comparison of the comparative examples 1 and 2 and the comparative examples 3 and 4, if an AC bias is applied to the secondary transfer nip N, it is understood that the cleaning performance is degraded. Like the examples 1 and 2, if the protective agent 22 (22Y, 22M, 22C, 22K) including at least zinc stearate and boron nitride was supplied, the cleaning performance was remarkably improved. This is because boron nitride supplied to each photosensitive element reaches the cleaning blade 37 of the intermediate transfer belt 31 and the cleaning blade 41B of the nip-forming roller 36.

Based on the difference between the examples 9 and 10, the protective agent can more stably be supplied, if the protective agent is supplied to the photosensitive element through the protective agent supply roller 4 (4Y, 4M, 4C, 4K) as the supply member. Thus, it is possible to stabilize the amount of boron nitride which reaches the cleaning blade 37 or the cleaning blade 41B of the nip-forming roller 36. Further, the amount of boron nitride can be more stable, with using urethane foam as a material of the supply member.

By providing the applying blade 5 (5Y, 5M, 5C, 5K) as a layer forming member, it is possible to stably control the amount of boron nitride which reaches the cleaning blade 37 or the cleaning blade 41B. Note that this layer forming member forms a coated film on the surface of each photosensitive element, by pressing the protective agent 22 (22Y, 22M, 22C, 22K) supplied to the surface of each photosensitive element.

In this embodiment, the cleaning blade 21 (21Y, 21M, 21C, 21K) is arranged between the downstream side of the primary transfer nip N1 as a transfer unit from each photosensitive element to the intermediate transfer belt 31 and the upstream side with respect to the protective agent supply roller 4 (4Y, 4M, 4C, 4K). The cleaning blade 21 removes the residual toner on the surface of the photosensitive element therefrom through friction with the photosensitive element. The residual toner is removed by the cleaning blade 21 (21Y, 21M, 21C, 21K), before applying the protective agent using the protective agent supply roller 4 (4Y, 4M, 4C, 4K). This results in uniform application of the protective agent.

Because the surface of the photosensitive element includes an ultraviolet cured resin, the photosensitive element itself has a long life. Thus, if the member included in the primary transfer nip N1 and the secondary transfer nip N have the extended life using the example of the present invention, the system life can be extended as a whole.

In this embodiment, an AC bias is applied to the transfer unit. Thus, normally, it is necessary to apply the protective agent including zinc stearate and boron nitride onto the intermediate transfer belt 31. However, if the protective agent including zinc stearate and boron nitride is used, for each photosensitive element, only zinc stearate is necessary as a protective agent for the intermediate transfer belt 31, thus attaining a reduction in cost.

If the adjacent-type or contact-type roller charging device 6 (6Y, 6M, 6C, 6K) as a charging unit is used, the charging hazard more increases than that of the corona charger. If an AC component is applied, the charging hazard further increases, thus attaining the great effect of using the protective agent of this embodiment.

Figure 16A:
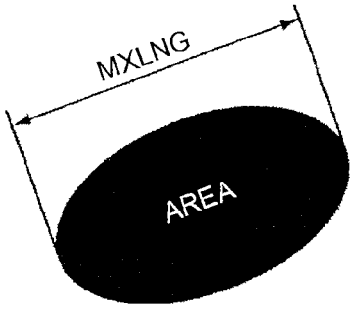
FIG. 16A is a diagram for explaining the circularity of a toner.
Figure 16B:
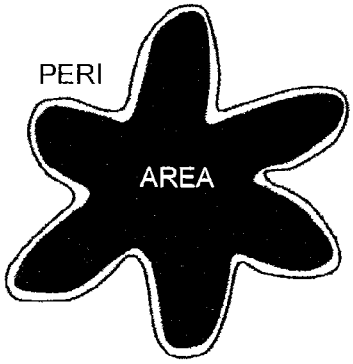
FIG. 16B is a diagram for explaining a ratio of the weight mean diameter to the number mean diameter of a toner.

In this embodiment, as illustrated in FIGS. 16A and 16B, circularity SR of a toner particle is from 0.93 to 1.00, as expressed by the following equation (1):

$$\text{Circularity } SR = (\text{circumference of a circle with the same area as a project area of the toner particle})/(\text{circumference of the project area of the toner particle}) \quad (1)$$

In addition, as a developer, a toner, whose ratio (D4/D1) of a weight average diameter (D4) to the number average diameter (D1) is 1.00 to 1.40, is used. To attain high image quality as demanded in recent years, the toner with small particles and an approximate round form is used, thus requiring the severe cleaning performance. However, if the protective agent B (22) described in this embodiment is applied to each photosensitive element, preferable cleaning performance can be attained, even when using the toner with small particles and the approximate round form.

As seen from the examples 5 to 8, the protective agent 42A including at least zinc stearate is applied or attached onto the surface of the intermediate transfer belt 31. This can prevent filming that is likely to occur due to application of an AC component to the secondary transfer nip N. If the protective agent 42B including at least zinc stearate is applied or attached onto the surface of the nip-forming roller 36, it is possible to prevent filing that is likely to occur due to application of an AC component to the secondary transfer nip N.

From the differences between the comparative examples 3 and 4 and the comparative examples 5 and 6, the following can be said. As an AC component to be applied to the secondary transfer nip N, a time average value (Vave) of the voltage is set with the polarity in the transfer direction, which enabling transfer of the toner image from the intermediate transfer belt 31 to the recording member P, and also set to a value shifted, on the waveform of the voltage, toward the transfer direction from the center value (Voff) between the maximum value and the minimum value of the voltage. In this case, though the cleaning performance may further be degraded, the protective agent can effectively be used like the examples 3 and 4.

Second Embodiment

In the second embodiment, attention is made to the relationship between the secondary transfer bias and the recording member P.

The shorter the distance L between sheets of paper (that is, between the first recording member P and the next recording member P), the larger the number of feeding sheets of paper per unit time. Thus, high productivity can be attained. However, if the distance L between the sheets of paper is short, the cleaning performance is degraded due to the insufficient cleaning. It cannot categorically be said that the shorter distance L is better, and it is necessary to consider both the productivity and the cleaning performance. The distance L between the sheets of paper implies a distance from the end part of the first recording member P to the front part of the next recording member P. The distance L between the sheets of paper can be obtained and set, based on the feeding timing of the recording member P.

The second embodiment of the present invention includes two transfer modes. In one transfer mode, a voltage with an AC component is applied in which the voltage is alternatively switched in the transfer direction and in the opposite direction. In the other transfer mode, only a voltage with a DC component is applied as a voltage in the transfer direction. The distance L between the sheets of paper (that is, between the first recording member P and the second recording member P) is set longer in the transfer mode in which the voltage with the AC component is applied, than in the transfer mode in which the voltage including only a voltage (DC component) in the transfer direction is applied.

In another embodiment of the present invention, as the peak-to-peak value (Vpp) becomes large, the distance L between the sheets of paper is set longer. The peak-to-peak value is an amplitude between the voltage in the transfer direction and the voltage of the polarity opposite to that of the voltage in the transfer direction of a waveform.

TABLE 3

| Distance L between paper | DC | AC6 kV [Vpp] | AC8 kV [Vpp] | AC10 kV [Vpp] |
|---|---|---|---|---|
| 40 mm | ○ | Δ | x | x |
| 50 mm | ○ | ○ | Δ | x |
| 60 mm | ○ | ○ | ○ | x |
| 70 mm | ○ | ○ | ○ | ○ |
| 80 mm | ○ | ○ | ○ | ○ |

Table 3 illustrates evaluated cleaning performance. As a secondary transfer bias, the DC component is constant and the peak-to-peak value of the AC component is changed. The bias is applied, and the distance L between the sheets of paper is changed. The evaluation is made under the same conditions, except the distance L between the sheets of paper and a value of the secondary transfer bias. In Table 3, symbols "○", "Δ", and "x" represent the evaluated contents of the cleaning performance. The symbol "○" represents "good", "Δ" represents "slightly poor", and "x" represents "poor".

As obvious from Table 3, when the secondary transfer bias with only the DC component [DC] was applied to the secondary transfer nip N, the cleaning performance was better regardless of the distance L between the sheets of paper, than when the AC component [AC] was applied as a secondary transfer bias to the secondary transfer nip N. When the AC component was applied as a secondary transfer bias to the secondary transfer nip N, the cleaning performance was poor, if the distance L was short between the sheets of paper. On the other hand, the cleaning performance was very good, if the distance L was long between the sheets of paper. Even when an AC component [AC] was applied as a secondary transfer bias to the secondary transfer nip N, the cleaning performance was very good, as the peak-to-peak value (Vpp) becomes large, that is, the distance L was long between the sheets of paper in accordance with the change from AC6 kV to AC10 kV.

In general, when the voltage (AC bias) with an AC component is applied as a secondary transfer bias, the cleaning performance of the nip-forming roller 36 as the secondary transfer member is degraded. At this time, if the distance L between the sheets of paper is extended, the protective agent 22 (22Y, 22M, 22C, 22K) including both zinc stearate and boron nitride can be supplied for a long period of time to the secondary transfer nip N through the intermediate transfer belt 31 and the nip-forming roller 36. As a result, a large amount of the protective agent 22 (22Y, 22M, 22C, 22K) can be supplied to the secondary transfer nip N, the insufficient cleaning at the application of the voltage with the AC component can be covered, and the cleaning performance at the application of the voltage with the AC component can be maintained.

As the voltage with the AC component (AC bias) is high, the cleaning performance of the nip-forming roller 36 is degraded. At this time, if the distance L between the sheets of paper is extended, the cleaning performance will be preferable. This is because the protective agent 22 (Y, M, C, K) including both of zinc stearate and boron nitride can be supplied for a long period of time to the secondary transfer nip N. As a result, a large amount of the protective agent 22 (22Y, 22M, 22C, 22K) can be supplied to the secondary transfer nip N, the insufficient cleaning at the application of the voltage with the AC component can be covered, and the cleaning performance at the application of the voltage with the AC component can be maintained.

Third Embodiment

Japanese Patent Application Laid-open No. 2006-350240 discloses a technique for applying a protective agent with a compound of metal salt of fatty acid and boron nitride to an intermediate transfer belt 50 as an intermediate transfer body, resulting in a high cost. In consideration of the above problem, it is accordingly an object of the third embodiment to improve the cleaning performance of the intermediate transfer body, while attaining the stable density of the image at low cost.

Like the second embodiment, the third embodiment includes two modes. In one transfer mode, a voltage with an AC component is applied in which the voltage is alternatively switched in the transfer direction and the opposite direction. In the other transfer mode, only a voltage with a DC component is applied as a voltage in the transfer direction. The distance L between the sheets of paper (that is, between the first recording member P and the second recording member P) is set longer in the transfer mode in which the voltage with the AC component is applied, than in the transfer mode in which the voltage including only a voltage (DC component) in the transfer direction is applied.

Figure 17:
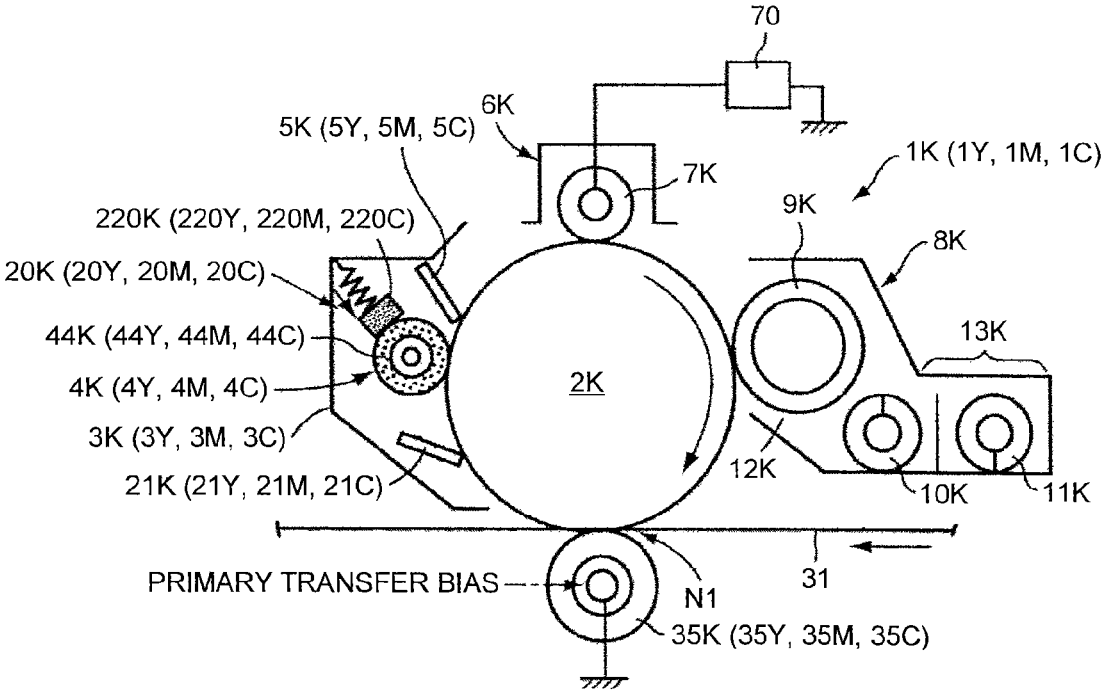
FIG. 17 is an enlarged diagram illustrating a schematic view of an image forming unit of an image forming apparatus according to a third embodiment of the present invention.

As illustrated in FIG. 17, in the third embodiment, what differs from the second embodiment is a point that protective agents 220Y, 220M, 220C, and 220K including at least metal salt of fatty acid and without boron nitride are used instead of the protective agent 22 (22Y, 22M, 22C, 22K) including at least both of zinc stearate and boron nitride. Any other configurations are same as those of the second embodiment, and thus their reference symbols in FIG. 17 will not repeatedly be described.

In the third embodiment, as the peak-to-peak value (Vpp) is large, the distance L between the sheets of paper is set longer. The peak-to-peak value is an amplitude between the voltage in the transfer direction and the voltage in the opposite direction.

TABLE 4

| Distance L between paper | DC | AC6 kV [Vpp] | AC8 kV [Vpp] | AC10 kV [Vpp] |
|---|---|---|---|---|
| 40 mm | Δ | x | x | x |
| 50 mm | ○ | Δ | x | x |
| 60 mm | ○ | ○ | Δ | x |
| 70 mm | ○ | ○ | ○ | Δ |
| 80 mm | ○ | ○ | ○ | ○ |

Table 4 illustrates evaluated cleaning performance. As a secondary transfer bias, the DC component is constant, and the peak-to-peak value of the AC component is changed. The bias is applied, and the distance L between the sheets of paper is changed. The evaluation is made under the same conditions, except the distance L between the sheets of paper and a value of the secondary transfer bias. In Table 4, symbols "○", "Δ", and "x" represent the evaluated contents of the cleaning performance. The symbol "○" represents "good", "Δ" represents "slightly poor", and "x" represents "poor".

As obvious from Table 4, when the secondary transfer bias with only the DC component [DC] was applied to the secondary transfer nip N, the cleaning performance was better regardless of the distance L between the sheets of paper, than when the AC component [AC] was applied as a secondary transfer bias to the secondary transfer nip N. When the AC component was applied as a secondary transfer bias to the secondary transfer nip N, the cleaning performance was poor, if the distance L was short between the sheets of paper. On the contrary, the cleaning performance was very good, if the distance L was long between the sheets of paper. Even when an AC component [AC] was applied as a secondary transfer bias to the secondary transfer nip N, the cleaning performance was very good, as the peak-to-peak value (Vpp) became large, that is, as the distance L was long between the sheets of paper in accordance with the change from AC6 kV to AC10 kV.

In general, when the voltage [AC bias] with an AC component is applied as a secondary transfer bias, the cleaning performance of the nip-forming roller 36 as the secondary transfer member is degraded. At this time, if the distance L between the sheets of paper is extended, the protective agent 220 (220Y, 220M, 220C, 220K) including at least metal salt of fatty acid and without boron nitride can be supplied for a long period of time to the secondary transfer nip N through the intermediate transfer belt 31 and the nip-forming roller 36. As a result, a large amount of the protective agent 220 (220Y, 220M, 220C, 220K) can be supplied to the secondary transfer nip N, the insufficient cleaning at the application of the voltage with the AC component can be covered, and the cleaning performance at the application of the voltage with the AC component can be maintained.

As the voltage with the AC component [AC bias] is high, the cleaning performance of the nip-forming roller 36 is degraded. At this time, if the distance L between the sheets of paper is extended, the cleaning performance will be preferable. This is because the protective agent 220 (220Y, 220M, 220C, 220K) including at least metal salt of fatty acid and without boron nitride can be supplied for a long period of time to the secondary transfer nip N. As a result, a large amount of the protective agent 220 (220Y, 220M, 220C, 220K) can be supplied to the secondary transfer nip N, the insufficient cleaning at the application of the voltage with the AC component can be covered, and the cleaning performance at the application of the voltage with the AC component can be maintained.

Fourth Embodiment

An object of the fourth embodiment of the present invention is to provide a technique for improving the cleaning performance for the photosensitive element, while attaining the stable density of the image at low cost.

Figure 18:
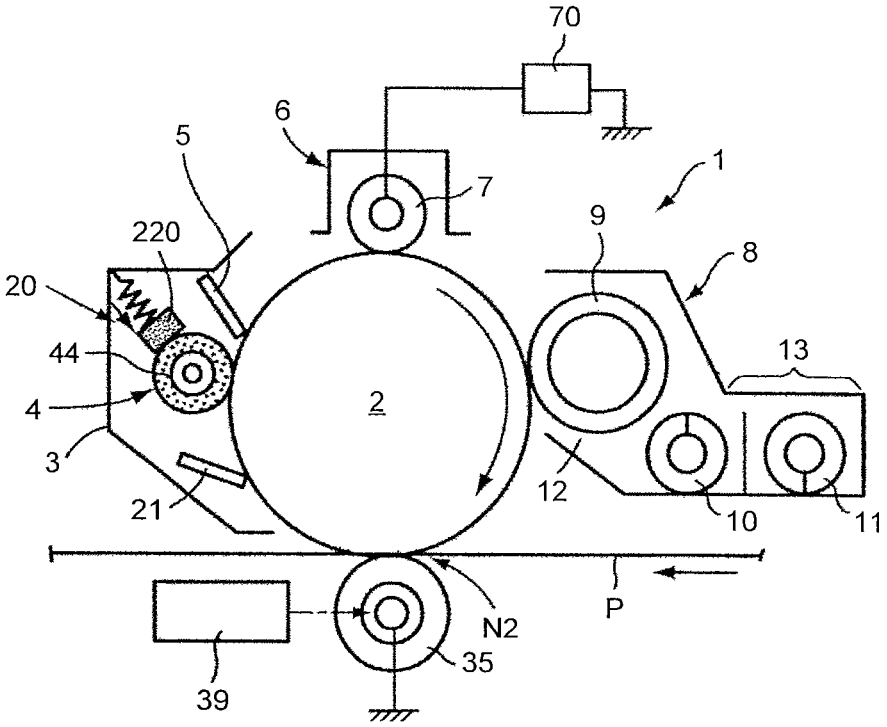
FIG. 18 is an enlarged diagram illustrating a schematic view of an image forming unit of an image forming apparatus according to a fourth embodiment of the present invention.

The image forming apparatus according to the fourth embodiment uses what is so-called a direct transferring method, instead of the image forming apparatus according to the third embodiment, as illustrated in FIG. 18. In the direct transfer method, a toner image carried on the photosensitive element 2 as an image carrier is directly transferred onto the recording member P. This image forming apparatus includes the photosensitive element 2 which supports a toner and a transfer roller 35 as a transfer member which forms a transfer nip N in contact with the surface supporting the toner image of the photosensitive element 2. The image forming apparatus includes a power supply 3 which outputs a voltage for transferring the toner image on the photosensitive element 2 onto the recording member P put in the transfer nip N2. The image forming apparatus includes the protective member supply unit 20 for applying and adhering the protective agent 220 including at least metal salt of fatty acid and without boron nitride onto the surface of the photosensitive element 2.

The voltage from the power supply 39 is alternatively switched in the transfer direction and in opposite direction when the toner image on the photosensitive element 2 is transferred to the recording member P. As described above, the voltage in the transfer direction enables transfer of the toner image from the intermediate transfer body to the recording member, and the voltage in the opposite direction has polarity opposite to polarity of the voltage in the transfer direction. The image forming apparatus includes two transfer modes. In one transfer mode, the voltage is switched in the transfer direction and in the opposite direction. In the other transfer mode, only the voltage in the transfer direction is applied. In the image forming apparatus, the distance L between the first recording member P and the next recording member P is set longer in the transfer mode in which the voltage is alternatively switched in the transfer direction and in the opposite direction, than in the transfer mode in which the voltage in the transfer direction is applied. Other constituent elements are the same as those of the third embodiment. The distance between the first recording member P and the next recording member P may be set such that the larger the peak-to-peak value (Vpp) of the voltage, the longer the distance between the first recording member P and the next recording member P.

In any one of the first to third embodiments, as the intermediate transfer body, an intermediate transfer drum with a drum-like form may be used in place of the intermediate transfer belt 50 with a belt form. As a secondary transfer member, a secondary transfer belt with a belt form may be used in place of the secondary transfer roller 36 with a roller form. In the fourth embodiment, as a transfer member, a transfer belt with a belt-like form may be used in place of the transfer roller 35 with a roller form.

According to the present invention, an image forming apparatus applies a voltage including a so-called AC bias to a transfer nip for transferring a toner image on an intermediate transfer body to a recording member. This voltage is alternatively switched between a voltage of a transfer direction for transferring the toner image from the intermediate transfer body to the recording member and a voltage with the polarity opposite to that of the voltage in the transfer direction. Using this image forming apparatus, an image of stable density can be attained. In addition, the cleaning performance for the intermediate transfer body can be improved, by supplying the image carrier with a protective agent including at least zinc stearate and boron nitride.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries an electrostatic latent image;

a developing unit that develops the electrostatic latent image using a toner;

an intermediate transfer body onto which a toner image developed by the developing unit is transferred once or a plurality of times and which carries the toner image;

a secondary transfer member that comes in contact with a surface of the intermediate transfer body on which the toner image is carried, to form a transfer nip;

a power supply that outputs a voltage for transferring the toner image on the intermediate transfer body onto a recording member put in the transfer nip; and a first protective agent supply unit that applies or attaches a protective agent including at least both of zinc stearate and boron nitride onto a surface of the image carrier, wherein the voltage is alternatively switched in a transfer direction and an opposite direction when the toner image on the intermediate transfer body is transferred to the recording member, the voltage in the transfer direction enabling transfer of the toner image from the intermediate transfer body to the recording member, and the voltage in the opposite direction including polarity opposite to polarity of the voltage in the transfer direction, the apparatus has a first transfer mode for alternatively switching the voltage in the transfer direction and in the opposite direction, and a second transfer mode for applying only the voltage in the transfer direction, and a distance between a first recording member and a next recording member is set longer in the first transfer mode than in the second transfer mode.

2. The image forming apparatus according to claim 1, wherein the first protective agent supply unit has a supply member that supplies the protective agent to the surface of the image carrier.

3. The image forming apparatus according to claim 2, wherein the supply member is a protective agent supply roller that has a foaming elastic layer on its surface.

4. The image forming apparatus according to claim 1, further comprising a layer formation member that presses the protective agent supplied to the surface of the image carrier, to form a coated film.

5. The image forming apparatus according to claim 1, further comprising a cleaning member that is arranged on a downstream side of a transfer nip formed between the image carrier and the intermediate transfer body and an upstream side of the first protective agent supply unit in a rotational direction of the image carrier, and that removes a residual toner on the surface of the image carrier therefrom through friction with the image carrier.

6. The image forming apparatus according to claim 1, wherein the image carrier includes an ultraviolet cured resin in a layer formed on an uppermost surface thereof.

7. The image forming apparatus according to claim 1, further comprising a charging unit that is arranged in contact with or adjacent to the surface of the image carrier.

8. The image forming apparatus according to claim 7, wherein the charging unit includes a charging voltage applying unit that applies a voltage including an AC component.

9. The image forming apparatus according to claim 1, wherein the image forming apparatus uses the toner formed such that circularity SR of a toner particle is from 0.93 to 1.00, as expressed by the following equation:

circularity $SR$ =(circumference of a circle with same projected area as a projected area of the toner particle)/(circumference of the projected area of the toner particle).

10. The image forming apparatus according to claim 1, wherein the image forming apparatus uses the toner formed such that a ratio (D4/D1) of a weight average diameter (D4) to a number average diameter (D1) is 1.00 to 1.40.

11. The image forming apparatus according to claim 1, further comprising a second protective agent supply unit that applies or attaches a protective agent including at least zinc stearate onto a surface of the intermediate transfer body.

12. The image forming apparatus according to claim 1, further comprising a third protective agent supply unit that applies or attaches a protective agent including at least zinc stearate on a surface of the secondary transfer member.

13. The image forming apparatus according to claim 1, wherein a time average value of the voltage is set with polarity in the transfer direction and that is set to a value shifted toward the transfer direction from a center value between a maximum value and a minimum value of the voltage on a voltage waveform.

14. The image forming apparatus according to claim 1, wherein a distance between a first recording member and a next recording member is set to a first distance when a peak-to-peak value of the voltage is a first value, and the distance between the first recording member and the next recording member is set to a second distance that is longer than the first distance when a peak-to-peak value of the voltage is a second value that is larger than the first value, the peak-to-peak value being an amplitude between the voltage in the transfer direction and the voltage in the opposite direction.

15. The image forming apparatus according to claim 1, comprising:

a plurality of the image carriers; and a plurality of the first protective agent supply units that are provided respectively corresponding to the image carriers, wherein the first protective agent supply units apply the protective agent including both of zinc stearate and boron nitride onto surfaces of the image carriers, respectively.

16. The image forming apparatus according to claim 1, wherein in one cycle in which the voltage is alternatively switched the power supply outputs the voltage in the transfer direction for a longer duration of time than the voltage in the opposite direction.

17. An image forming apparatus comprising:

a photosensitive member onto which a toner image is formed;

an intermediate transfer member onto which the toner image is transferred from the photosensitive member;

a secondary transfer member to form a transfer nip between the intermediate transfer member and the secondary transfer member;

a power supply to output a voltage to transfer the toner image from the intermediate transfer member to a recording medium in the transfer nip, the voltage being alternately switched between a first peak voltage to move the toner image from the intermediate transfer member to the recording medium and a second peak voltage including a polarity opposite to a polarity of the first peak voltage, and a time averaged voltage of the voltage being set to a first peak voltage side relative to a center value between the first peak voltage and the second peak voltage;

a first lubricant supply unit to supply a lubricant agent onto the intermediate transfer member; and a second lubricant supply unit to supply the lubricant agent onto the secondary transfer member, wherein a duration in which the voltage is on a second peak voltage side relative to the center value is shorter than a duration in which the voltage is on the first peak voltage side relative to the center value in one cycle of the voltage.

18. The image forming apparatus according to claim 17, wherein a waveform of the voltage includes a square shape.

19. The image forming apparatus according to claim 17, wherein the lubricant agent includes at least metal salt of fatty acid.

20. The image forming apparatus according to claim 19, wherein the lubricant agent includes at least zinc stearate.

21. An image forming apparatus, comprising:

a photosensitive member onto which a toner image is formed;

an intermediate transfer member onto which the toner image is transferred from the photosensitive member;

a secondary transfer member to form a transfer nip between the intermediate transfer member and the secondary transfer member;

a power supply to output a voltage to transfer the toner image from the intermediate transfer member to a recording medium in the transfer nip, the voltage being alternately switched between a first peak voltage to move the toner image from the intermediate transfer member to the recording medium and a second peak voltage including a polarity opposite to a polarity of the first peak voltage, and a time averaged voltage of the voltage being set to a first peak voltage side relative to a center value between the first peak voltage and the second peak voltage; and a lubricant supply unit to supply a lubricant agent onto the intermediate transfer member, wherein a duration in which the voltage is on a second peak voltage side relative to the center value is shorter than a duration in which the voltage is on the first peak voltage side relative to the center value in one cycle of the voltage.

22. The image forming apparatus according to claim 21, wherein a waveform of the voltage includes a square shape.

23. The image forming apparatus according to claim 21, wherein the lubricant agent includes at least metal salt of fatty acid.

24. The image forming apparatus according to claim 23, wherein the lubricant agent includes at least zinc stearate.

25. An image forming apparatus comprising:

an image carrier that carries an electrostatic latent image;

a developing unit that develops the electrostatic latent image using a toner:

an intermediate transfer body onto which a toner image developed by the developing unit is transferred once or a plurality of times and which carries the toner image;

a secondary transfer member that comes in contact with a surface of the intermediate transfer body on which the toner image is carried, to form a transfer nip;

a power supply that outputs a voltage for transferring the toner image on the intermediate transfer body; and a protective agent supply unit that applies or attaches a protective agent including at least metal salt of fatty acid without boron nitride onto a surface of the image carrier, wherein the voltage is alternately switched in a transfer direction and an opposite direction when the toner image of the intermediate transfer body is transferred to a recording member, the voltage in the transfer direction enabling transfer of the toner image from the intermediate transfer body to the recording member, and the voltage in the opposite direction including polarity opposite to polarity of the voltage in the transfer direction, the apparatus has a first transfer mode for alternately switching the voltage in the transfer direction and in the opposite direction, and a second transfer mode for applying only the voltage in the transfer direction, and a distance between a first recording member and a next recording member is set longer in the first transfer mode than in the second transfer mode.

26. The image forming apparatus according to claim 25, wherein a distance between a first recording member and a next recording member is set to a first distance when a peak-to-peak value of the voltage is a first value, and the distance between the first recording member and the next recording member is set to a second distance that is longer than the first distance when a peak-to-peak value of the voltage is a second value that is larger than the first value, the peak-to-peak value being an amplitude between the voltage in the transfer direction and the voltage in the opposite direction.

27. An image forming apparatus comprising:

an image carrier that carries a toner;

a transfer member that comes in contact with a surface of the image carrier on which a toner image is earned, to form a transfer nip;

a power supply that outputs a voltage for transferring the toner image on the image carrier to a recording member put in the transfer nip; and a protective agent supply unit that applies or attaches a protective agent including at least metal salt of fatty acid without boron nitride to the surface of the image carrier, wherein the voltage is alternately switched in a transfer direction and an opposite direction when the toner image on the image carrier is transferred to the recording member, the voltage in the transfer direction enabling transfer of the toner image from the image carrier to the recording member, and the opposite voltage including polarity opposite to polarity of the voltage in the transfer direction, the apparatus has a first transfer mode for alternately switching the voltage in the transfer direction and in the opposite direction, and a second transfer mode for applying only the voltage in the transfer direction, and a distance between a first recording member and a next recording member is set longer in the first transfer mode than in the second transfer mode.

28. The image forming apparatus according claim 27, wherein a distance between a first recording member and a next recording member is set to a first distance when a peak-to-peak value of the voltage is a first value, and the distance between the first recording member and the next recording member is set to a second distance that is longer than the first distance when a peak-to-peak value of the voltage is a second value that is larger than the first value, the peak-to-peak value being an amplitude between the voltage in the transfer direction and the voltage in the opposite direction.

29. An image forming apparatus, comprising:

a photosensitive member onto which a toner image is formed;

an intermediate transfer member onto which the toner image is transferred from the photosensitive member;

a secondary transfer member to form a transfer nip between the intermediate transfer member and the secondary transfer member;

a power supply to output a voltage to transfer the toner image from the intermediate transfer member to a recording medium in the transfer nip, the voltage being alternately switched between a first peak voltage to move the toner image from the intermediate transfer member to the recording medium and a second peak voltage including a polarity opposite to a polarity of the first peak voltage, and a time averaged voltage of the voltage being set to a first peak voltage side relative to a center value between the first peak voltage and the second peak voltage; and a lubricant supply unit to supply a lubricant agent onto the secondary transfer member, wherein a duration in which the voltage is on a second peak voltage side relative to the center value is shorter than a duration in which the voltage is on the first peak voltage side relative to the center value in one cycle of the voltage.

30. The image forming apparatus according to claim 29, wherein a waveform of the voltage includes a square shape.

31. The image forming apparatus according to claim 29, wherein the lubricant agent includes at least metal salt of fatty acid.

32. The image forming apparatus according to claim 31, wherein the lubricant agent includes at least zinc stearate.

* * * * *